US005902374A

United States Patent [19]

Kitamura et al.

[11] Patent Number: 5,902,374

[45] Date of Patent: May 11, 1999

[54] VACUUM REFINING METHOD FOR MOLTEN STEEL

[75] Inventors: Shinya Kitamura, Futtsu; Kimitoshi Yonezawa, Tokyo; Kenichiro Miyamoto, Kitakyushu; Shinji Sasakawa, Kitakyushu; Kunihiko Fujiwara, Kitakyushu, all of Japan

[73] Assignee: Nippon Steel Corporation, Tokyo, Japan

[21] Appl. No.: 08/817,269

[22] PCT Filed: Aug. 6, 1996

[86] PCT No.: PCT/JP96/02173

§ 371 Date: Mar. 28, 1997

§ 102(e) Date: Mar. 28, 1997

[87] PCT Pub. No.: WO97/05291

PCT Pub. Date: Feb. 13, 1997

[30] Foreign Application Priority Data

Aug. 1, 1995 [JP] Japan ..... 7-196760
Aug. 4, 1995 [JP] Japan ..... 7-200110

[51] Int. Cl.[6] ..... C21C 7/00

[52] U.S. Cl. ..... 75/508; 75/507; 75/392; 75/414; 75/433; 75/59; 75/60; 75/49

[58] Field of Search ..... 75/508, 507, 392, 75/414, 433, 59, 60, 49

[56] References Cited

U.S. PATENT DOCUMENTS 3,971,655 7/1976 Takashima et al. ..... 75/59
5,304,231 4/1994 Kato et al. ..... 75/258

FOREIGN PATENT DOCUMENTS 2460291 8/1975 Germany .
58-9914 1/1983 Japan .
61-37912 2/1986 Japan .
1-156416 6/1989 Japan .
2-54714 2/1990 Japan .
5-105936 4/1993 Japan .
5-171253 7/1993 Japan .
5-287357 11/1993 Japan .
6-116626 4/1994 Japan .
6-116627 4/1994 Japan .
6-212241 8/1994 Japan .
6-228629 8/1994 Japan .
7-179930 7/1995 Japan .

OTHER PUBLICATIONS

"CAS–OB Method" in S1086 of vol. 71 of "Iron and Steel", published in 1985.
"ASM Handbook", Formerly Ninth Edition, Metals Handbook, vol. 15, Casting.

*Primary Examiner*—Patrick Ryan
*Assistant Examiner*—M. Alexandra Elve
*Attorney, Agent, or Firm*—Kenyon & Kenyon

[57] ABSTRACT

The present invention relates to a molten steel refining method for refining molten steel, the carbon content of which is not more than 0.1 weight %, by blowing oxygen gas for decarburization at a blowing speed so that a cavity, the depth of which is 150 to 400 mm, can be formed on the surface of molten steel in a straight barrel type vacuum refining apparatus in which a straight barrel type vacuum vessel having no vessel bottom and a ladle are arranged. When necessary, the above decarburizing processing conducted by blowing oxygen gas is combined with: an Al heating process in which Al added into the vacuum vessel is burned by oxygen gas blown into the vacuum vessel at a blowing speed such that the cavity depth can be 50 to 400 mm; a degassing treatment conducted in a high vacuum condition; a desulfurizing treatment in which a desulfurizing agent is blown into the vacuum vessel; or a burner heating treatment in which a combustion improving agent is blown together with oxygen gas, wherein each treatment except for the high vacuum degassing treatment is conducted in a degree of vacuum of 100 to 400 Torr.

25 Claims, 6 Drawing Sheets

◎ : DECARBURIZING OXYGEN EFFICIENCY > 80%

× : DECARBURIZING OXYGEN EFFICIENCY < 60%

VACUUM REFINING METHOD FOR MOLTEN STEEL

BACKGROUND OF THE INTENTION

1. Field of the Invention

The present invention relates to a vacuum refining method for molten steel. More particularly, the present invention relates to a vacuum refining method for refining molten steel with a straight barrel type vacuum vessel having no vessel bottom.

2. Description of the Related Art

In a vacuum refining furnace, oxygen gas is blown onto molten steel to be refined by means of top-blowing. The objects of blowing oxygen gas by means of top-blowing are described as follows. The first object is "decarburization" in which oxygen gas is reacted with carbon contained in the molten steel when oxygen gas is blown. The second object is "Al heating" in which the temperature of molten steel is raised when Al added to molten steel is burned by oxygen gas blown onto the molten steel by means of top-blowing. The third object is "desulfurization" in which flux, such as lime, is added to molten steel together with carrier gas. The fourth object is "burner heating" in which oxygen gas and combustion improving gas of a hydrocarbon, such as LNG, are blown by means of top-blowing so as to heat a vacuum vessel and suppress the adhering metal.

Conventionally, DH is known as a vacuum refining furnace composed of a straight barrel type vacuum vessel and a dipping snorkel. However, in the case of DH, a vacuum vessel to circulate molten steel goes up and down, and no molten steel exists in the vacuum vessel when it is moved to the uppermost position. Accordingly, in the case of blowing oxygen gas by means of top-blow, oxygen gas directly collides with the bottom of the vacuum vessel. Therefore, refractory material of the vessel bottom is severely damaged by the colliding oxygen gas. For the above reason, a method of blowing oxygen gas from a top-blowing lance has not been adopted at all.

Although it is not a case of vacuum refining, a secondary refining furnace in which the top-blowing of oxygen gas is conducted with a straight barrel type dipping snorkel is described as "CAS-OB Method" in S1086 of vol. 71 of "Iron and Steel" published in 1985. The object of the above method is to raise the temperature of molten steel by burning Al. However, the following problems may be encountered according to the above method. In the above method, it is impossible to conduct pressure reduction processing. Accordingly, when it is necessary to conduct a very low carbon steel melting processing and a dehydrogenation processing together with "Al heating", it is necessary to provide another refining furnace, so that the equipment cost is increased. Since the operation is conducted under atmospheric pressure, molten steel can not be sufficiently agitated, and the heat transfer efficiency is low. In order to improve the heat transfer efficiency, it is necessary to extend the processing time.

In the decarburizing reaction treatment conducted for producing ultra low carbon steel by means of top blown oxygen in a region, the carbon concentration is not more than 0.1%. Since the carbon concentration is very low, oxygen gas which has been blown out by means of top-blowing temporarily generates an iron oxide on the surface of molten steel, and this iron oxide reacts with and is reduced by carbon contained in the molten steel. In order to facilitate the reducing reaction, it is necessary to raise the hot point so as to form an advantageous condition from the viewpoints of thermodynamics and reaction speed. Therefore, it is necessary to conduct a so called hard-blowing operation in which the top-blown oxygen is made to collide with the surface of molten steel at high jet intensity.

With regard to a molten steel refining method in which an RH type vacuum refining apparatus having a vessel bottom is used and a water-cooled type top-blowing lance inserted into a vacuum vessel from an upper portion blows out a jet stream of oxygen into the vacuum vessel for refining molten steel, an example is shown in Japanese Unexamined Patent Publication No. 2-54714. Therefore, this molten steel refining method is well known.

FIG. 8 is a schematic illustration showing a refining method of molten steel conducted by a conventional RH type vacuum degasifying apparatus. The operation will be explained below. There is provided a snorkel of up-leg 23 at the vessel bottom 22 of the vacuum vessel 21. Gas is blown into the vacuum vessel 21 from a lower end of the snorkel of up-leg 23, so that the molten steel 24 can be sucked up from a ladle 25 to the vacuum vessel 21. In the vacuum vessel 21, an oxygen jet 27 is blown out from a top-blowing lance 26 to the surface of the molten steel 24. In this way, the molten steel 24 is subjected to decarburizing processing and Al heating, and the thus processed molten steel 24 is returned to the ladle 25 via a snorkel of down-leg 28. When the molten steel 24 is circulated between the ladle 25 and the vacuum vessel 21 in this way, it is continuously processed.

However, when oxygen is fed from the top-blowing lance 26 in the RH type vacuum refining apparatus described above, since the vacuum vessel 21 has a vessel bottom 22, the operation is restricted in various ways, and the following problems may be encountered.

In the RH type vacuum refining apparatus, vacuum necessary for sucking up the molten steel 24 from the ladle 25 so as to make the molten steel 24 reach the vessel bottom 22 of the vacuum vessel 21 is usually not more than 200 Torr. In order to circulate the molten steel 24 after that, vacuum is further enhanced, and it becomes necessary to maintain a high vacuum of not more than 150 Torr. Further, when oxygen gas is blown out from the top-blowing lance 26 in a reduced pressure condition, it is necessary to maintain a high vacuum condition. Unless a high vacuum condition is maintained, an oxygen jet 27 collides with the vessel bottom 22, and the refractory material at the vessel bottom is damaged because the molten steel depth T is small. Accordingly, in the case of conducting the hard blowing operation, the following restrictions must be observed. In order to keep the depth L of a cavity 29, for example, it is necessary to keep a very high vacuum of about 10 Torr so that the head of molten steel can be raised to maintain the depth T of molten steel on the vessel bottom 22 in the vacuum vessel 21.

In the case where oxygen is blown out from the top-blowing lance at a low degree of vacuum, a quantity of molten steel to be sucked is small, so that the depth T of molten steel in the vacuum vessel 21 is small. Therefore, for the same reason as that described above, the oxygen jet 27 collides with the vessel bottom 22, and the refractory material at the vessel bottom is damaged. Therefore, the depth L of the cavity formed by the oxygen jet 27 is restricted. As a result, it is impossible to conduct the hard-blowing operation, and it is necessary to conduct a so called soft-blowing operation in which the top-blown oxygen is made to collide with the surface of molten steel at low jet intensity.

Consequently, in the RH type vacuum refining apparatus, the following problems may be encountered. When oxygen gas is blown out in a reduced pressure, it is restricted as described above. Since it is impossible to conduct a hard-blowing operation in a low degree of vacuum at the beginning of the treatment, the reduction of iron oxide is delayed and the decarburizing reaction speed is lowered. In addition to that, the jet speed of the oxygen gas is low. Therefore, after the lance has been discharged, oxygen in the periphery of the jet reacts with CO gas in the atmosphere, so that $CO_2$ is generated. That is, the post combustion is actively conducted, for example, at a rate of post combustion that is not less than 20%. Accordingly, the temperature in the vessel is unnecessarily raised and the refractory material of the vacuum vessel is damaged.

On the other hand, when a vacuum refining apparatus, which will be referred to as a straight barrel type vacuum refining apparatus hereinafter, is used for refining, in which a lower portion of the straight barrel type vacuum vessel having no bottom is dipped in the molten steel in the ladle, it is possible to blow out oxygen even in a low degree of vacuum because there is provided no vessel bottom. When oxygen is blown out by means of top-blowing in the above refining apparatus, it is necessary to maintain the vacuum refining apparatus in a low degree of vacuum in order to facilitate the decarburizing reaction. The reason is that it is difficult for iron oxide to flow out from the vacuum vessel in the case of an unnecessarily high degree of vacuum, so that the decarburizing efficiency is lowered. To the contrary, when the degree of vacuum is too low, the circulation of molten steel is deteriorated, and molten steel can not be sufficiently mixed. Accordingly, the decarburizing efficiency is lowered.

Examples in which stainless steel is refined by means of top-blowing in the above straight barrel type vacuum refining apparatus are disclosed in Japanese Unexamined Patent Publication No. 1-156416, No. 61-37912, No. 5-105936 and No. 6-228629. In the above examples, the carbon concentration at which decarburization starts is in a high carbon concentration range of not less than 0.2%. Further, in the above patent publications, there is no specific description about the oxygen blowing condition.

In the decarburizing reaction conducted at the aforementioned high carbon concentration, the top-blown oxygen directly reacts with carbon in the molten steel since the carbon concentration is high. In the above circumstances, no iron oxide is generated. Accordingly, even if converter slag exists in the vacuum refining apparatus, no problems are caused. Also, since the carbon concentration is sufficiently high, the agitating and mixing characteristic and the decarburizing efficiency are not affected. Accordingly, in this case, the higher the vacuum in the vacuum refining apparatus is, the more effectively the decarburization can be conducted. In the above well-known documents, Japanese Unexamined Patent Publication No. 5-105936 discloses an example in which the degree of vacuum is maintained at 200 Torr, and Japanese Unexamined Patent Publications No. 1-156416, No. 61-037912 and No. 6-228629 disclose examples in which the degree of vacuum is kept at 100 Torr or 50 Torr.

In the case where the carbon concentration is high, from the viewpoint of the principle of decarburization, the higher the degree of vacuum is, the more advantageous the effect that can be provided. However, in order to keep the vacuum refining apparatus in a high vacuum condition, the investment in plant and equipment is necessarily increased for the vacuum pump system because a large quantity of CO gas is produced, and further molten steel splashes violently in the process. Therefore, it is necessary to increase the height of the apparatus for the prevention of splash. As a result, the investment in plant and equipment is increased. For the above reasons, in the above examples, the degree of vacuum is maintained at 100 Torr or 50 Torr. In the above well known documents, it is described that refining is continued until the carbon concentration becomes 0.01 to 0.02%. However, metallurgical effects are not shown when the carbon concentration is restricted to a value lower than 0.1%.

However, as described later, in a high vacuum condition in which the degree of vacuum is higher than 105 Torr, it is difficult for slag particles in the molten steel to flow out from the vessel, so that the decarburizing oxygen efficiency is low. Therefore, in the case of a degree of vacuum lower than 195 Torr, the agitating energy is reduced, and the molten steel can not be agitated and mixed sufficiently. For this reason, the decarburizing efficiency is lowered.

Japanese Unexamined Patent Publication No. 7-179930 discloses an example in which plain carbon steel was refined under the condition that the degree of vacuum was maintained at 200 Torr and oxygen was blown by means of top-blowing so that the carbon concentration was in a range from 0.03% to 0.001%. In this case, the post combustion rate was not less than 78%, and the decarburizing oxygen efficiency was very low. The reason was that the cavity depth, which was found by calculation using the expression described later, was only 52 mm. That is, the oxygen gas collided with the molten steel in the manner of soft blowing. Also, it can be considered that the degree of vacuum was too low, so that the molten steel was not agitated and mixed sufficiently and the decarburizing efficiency was further deteriorated. Japanese Unexamined Patent Publication No. 6-116627 discloses a method in which the molten steel, the carbon concentration of which is 0.03 to 1.0%, is subjected to a top-blown oxygen, and the vacuum P is controlled in accordance with the equation of P (Torr)=a+980×[%C] (a=170 to 370). The object of this method is nitrogen removal. Although there is no description about the decarburizing efficiency, the degree of vacuum is 199 to 399 Torr when the carbon concentration is 0.03% which is the lowest value. In the low degree of vacuum described above, the stirring energy is lowered. Therefore, the molten steel can not be stirring and mixed sufficiently, and the decarburizing efficiency is deteriorated. Further, there is no description about the manner of blowing of oxygen, which is an important factor to enhance the decarburizing efficiency, in the above patent publication. That is, there is no description of whether the hard blowing operation or the soft blowing operation is conducted.

Japanese Unexamined Patent Publication No. 6-116626 discloses a technique in which molten steel is refined in a degree of vacuum of 760 to 100 Torr while a mixing ratio of top blown oxygen gas and Ar gas is changed in accordance with the degree of vacuum. There is a description that the carbon concentration at the start of decarburization is 1.0 to 0.1%. This operation is mainly conducted at a high carbon concentration. Even in this case, there is no description about the manner of blowing of oxygen, which is an important factor to enhance the decarburizing efficiency, in the above patent publication. That is, there is no description of whether the hard blow operation or the soft blow operation is conducted. Further, there is no description about the effective decarburizing condition when pure oxygen gas is used.

In the prior art in which the straight barrel type vacuum refining apparatus is used, examples are shown in the case of a region in which the carbon concentration is high and also in the case in which the degree of vacuum is too low, wherein the decarburizing principles are quite different from each other. Concerning the oxygen blowing condition, it is only recognized that the soft blow operation is required in the example, and no technical investigation has been made into the appropriate oxygen blowing condition.

In the straight barrel type vacuum refining apparatus, the following operation is effective. Before blowing oxygen gas into the vacuum vessel for the purpose of decarburization, in order to raise the temperature of molten steel in the vacuum vessel of the refining apparatus, Al alloy is added to the molten steel. Top blown oxygen is fed onto the surface of the molten steel, so that Al is burned to raise the temperature of the molten steel. The aforementioned Al heating is a technique in which Al alloy is continuously added to the molten steel or Al alloy is added to the molten steel all at once, and during the above Al alloy adding operation, oxygen is top-blown to the molten metal, so that Al is oxidized and the temperature of molten steel is raised by the heat generated by the oxidization of Al. In this case, when carbon contained in the molten steel is oxidized, the amount of oxygen used for oxidizing Al is reduced. Therefore, it is not preferable to oxidize carbon contained in the molten steel. It is necessary to react the top-blown oxygen with Al at a high efficiency. Also, it is necessary to add the thus generated heat to the molten steel at a high efficiency. From the viewpoint of thermodynamics, carbon and Al are respectively oxidized as follows. When the partial pressure of CO is high, that is, when the vacuum is low, the oxidization of Al occurs prior to the oxidization of carbon. However, when the partial pressure of CO is low, that is, when the vacuum is high, the oxidization of carbon occurs prior to the oxidization of Al. Consequently, the appropriate degree of vacuum has not been known in the actual operation for the following reasons. Although a low vacuum is necessary for suppressing the oxidization of carbon, in a free surface region in which the reaction occurs, the temperature is raised by the reaction, and the partial pressure of CO is not same as the degree of vacuum.

Further, it is necessary to effectively discharge $Al_2O_3$ produced in the reaction outside the vacuum vessel. The reason is described below. When a large amount of $Al_2O_3$ is suspended on the surface of the vacuum vessel, since the heat conduction of $Al_2O_3$, which is an oxide, is low, $Al_2O_3$ becomes a resistance to heat transfer. Accordingly, the coefficient of heat transfer on the surface region of the vacuum vessel is deteriorated, so that heat transfer efficiency is lowered. In order to discharge slag from the vacuum vessel, it is necessary to keep the vacuum vessel in a low degree of vacuum. The reason why the vacuum vessel is kept in a low degree of vacuum condition is described as follows. When the vacuum vessel is kept in a high degree of vacuum, an interval between the lower end of the dipping portion and the surface of the molten steel in the vacuum vessel is increased, and slag particles in the molten steel are moved in a stream flowing downward. However, very few of the particles of slag arrive at the lower end of the dipping portion, and most slag particles are circulating in the vacuum vessel. The above slag flow rises to a bubble activating surface being carried by a rising stream. Therefore, an amount of $Al_2O_3$ suspended in the surface region is accumulated, so that the heat transfer efficiency is lowered.

An effective means for discharging $Al_2O_3$ from the straight barrel type vacuum refining apparatus has not been found.

In order to effectively transfer the generated heat to the entire molten steel, it is necessary that an amount of circulating molten steel is sufficiently large. In this case, the amount of circulating molten steel may be smaller than that in the case of blowing oxygen performed for the purpose of decarburization. The reason is that not only convection heat transmission conducted by a circulating molten steel flow but also conduction heat transmission caused by a difference in temperature contributes to the heat transfer. However, in the case where the degree of vacuum is too low, gas blown into the molten steel expands greatly when it rises to the surface. Accordingly, the stirring energy is reduced and the molten steel is not agitated and mixed sufficiently. As a result, the heat transfer efficiency is lowered. Therefore, it is necessary that the degree of vacuum is maintained at the most appropriate value.

It is described in Japanese Unexamined Patent Publication No. 58-9914 that desulfurization is conducted after the high vacuum treatment of decarburization or hydrogen removal in the refining method of molten steel performed at a reduced pressure. In the above patent publication, a method is disclosed in which powder for refining is blown onto molten steel in a reduced pressure at a sufficiently high speed so that the powder can get into the molten steel. According to the above method, a flow speed of gas to be blown to the molten steel must be not lower than Mach 1, that is, when the flow speed of gas is higher than Mach 1, the powder for refining can get into the molten steel sufficiently.

According to the above method, the flow speed of gas to be blown to the molten steel is very high as described above. Accordingly, the molten steel splashes, and a lance and refractory material in the vessel are damaged, and further the metal adheres to the inside of the vessel. In order to remove the adhering metal, it takes time and labor. In order to blow the gas at a high flow speed of not less than Mach 1, it is necessary to reduce the nozzle diameter of the lance. Therefore, when a refining agent is blown into the vacuum vessel by the top-blowing lance inserted into it, in addition to the usual oxygen blowing hole, it is necessary to form a new blowing hole exclusively used for blowing the refining agent, which causes a problem with respect to the apparatus. On the other hand, when the refining agent is blown by the oxygen blowing lance, it is necessary to feed a large amount of carrier gas to ensure the blowing speed. As a result, the temperature is lowered, and further the utility cost is increased.

Japanese Unexamined Patent Publications No. 5-287357 and No. 5-171253 disclose a method in which an RH type vacuum refining apparatus having a vessel bottom is used and powder used for refining is blown from a water-cooled top-blowing lance inserted into a vacuum vessel so as to refine molten steel.

In the above patent publications, the following are described. In order to enhance the powder trapping efficiency, it is preferable to conduct a hard blow operation. When the hard blow operation is conducted in an RH vacuum refining apparatus, it is necessary to prevent the oxygen jet from colliding with the vessel bottom. Therefore, when oxygen gas is blown into the vacuum vessel from the top-blowing lance, it is necessary to ensure a head of molten steel in accordance with the depth of a cavity formed on the molten steel surface. For this reason, when powder for refining is blown into the vacuum vessel, a high degree of vacuum of not more than 100 Torr must be maintained. However, when the vacuum vessel is maintained in a high degree of vacuum condition, the amount of powder which is exhausted with the exhaust gas is increased. As a result, the powder trapping efficiency with respect to molten steel is lowered, and the reaction efficiency is deteriorated. In order to enhance the powder trapping efficiency, the blowing speed must be increased.

Concerning the circulating speed of molten steel in the vessel or ladle of the conventional vacuum refining apparatus, the renewal speed of molten steel is not high, so that a high blowing speed is required. However, when a jet speed of carrier gas is increased for the purpose of increasing the blowing speed of powder used for refining, the amount of flowing gas is increased and also spitting is increased. Therefore, it is not preferable to increase the jet speed of carrier gas. As is conventionally known, the speed of powder is a half of the speed of carrier gas at most, and further it is reported that the depth of intrusion of powder is constant irrespective of an amount of flowing carrier gas. For the above reasons, it is not advantageous that the speed of carrier gas is increased.

An example in which a desulfurizing agent is blown to molten steel in a straight barrel type vacuum refining apparatus is disclosed in Japanese Unexamined Patent Publication No. 6-212241. However, in the above patent publication, there is no description about the vacuum and flow speed which are important factors to determined the efficiency.

As described above, there is no disclosure of the condition in which the desulfurizing agent is added to molten steel in the straight barrel type vacuum refining apparatus.

In the refining method of molten steel conducted in a reduced pressure, when the composition of molten steel is adjusted after the process of decarburization or the processing in a high degree of vacuum, the temperature in the vacuum vessel is raised to suppress the adhering metal. In order to accomplish the above object, the molten steel is subjected to burner heating by using a top-blowing lance, so that the temperature of molten steel can be raised.

In the above case, since the pressure in the vacuum vessel is reduced, the length of a combustion flame blown out from the top-blowing lance tends to extend. However, when the flame reaches the surface of molten steel, a combustion improver of hydrocarbon, which has not burned yet, reacts with the molten steel, so that the concentrations of carbon and hydrogen in the molten steel are increased, which causes a serious problem. In order to solve the above problem, the degree of vacuum may be lowered so as to shorten the length of the flame, or an interval between the lance and the molten steel surface may be increased. In the case of RH, in order to circulate the molten steel, the molten steel must be sucked up into the vacuum vessel. Therefore, it is impossible to reduce the degree of vacuum. Accordingly, only one method of increasing the lance height can be adopted. However, according to this method, an interval between the average flame region and the molten steel surface is increased. Therefore, the heat transfer efficiency is lowered.

With regard to the burner heating conducted in a straight barrel type vacuum refining apparatus, there is no specific disclosure.

SUMMARY OF THE INVENTION

An object of the present invention is to solve various problems of the prior art by providing the most appropriate refining condition in a vacuum vessel when molten steel is refined for decarburization in a straight barrel type vacuum refining apparatus.

That is, an object of the present invention is to provide the most appropriate vacuum and oxygen conditions in the vacuum vessel to refine molten steel.

Another object of the present invention is to provide the most appropriate Al heating method by which the temperature of molten steel in the vacuum vessel is raised to a predetermined value.

Still another object of the present invention is to provide the most appropriate desulfurizing condition for molten steel in the vacuum vessel.

Still another object of the present invention is to provide a method of heating the molten steel in the vacuum vessel and the surface of refractory material of the vacuum vessel by means of burner heating.

The above objects of the present invention can be accomplished by the following refining method.

The refining method of the present invention is described as follows. First, molten steel, the carbon content of which has been adjusted to be not more than 0.1% by means of decarburization conducted in a converter, is charged into a vacuum vessel of a straight barrel type vacuum refining apparatus. While the atmosphere in this vacuum vessel is maintained in a low degree of vacuum of 105 to 195 Torr, oxygen is blown to the molten steel, from a top-blowing lance, at a blowing speed such that the depth of a cavity with respect to the stationary molten steel surface in the vacuum vessel is 150 to 400 mm.

When the atmosphere in the vacuum vessel is maintained in the low degree of vacuum described above, it is possible to reduce an interval between a lower end of the dipping portion of the vacuum vessel and a surface of the molten steel in the vacuum vessel. Due to the foregoing, slag particles in the molten steel on the molten steel surface can be easily discharged from the lower end of the dipping portion of the vacuum vessel to the outside of the vacuum vessel. As a result, almost all the slag particles existing in the vacuum vessel can be discharged in a short period of time. Accordingly, iron oxide generated in the process of blowing oxygen by means of top-blowing can exist in the molten steel in the form of pure FeO. Due to the foregoing, the decarburizing oxygen efficiency can be maintained high.

In order to enhance the decarburizing efficiency, it is necessary to raise a temperature in a region (hot spot) where an oxygen jet blown out from the top-blowing lance impinges with the surface of molten steel. For this reason, in the present invention, oxygen is blown from the lance in a hard blow condition so that the depth of a cavity is 150 to 400 mm. Even when oxygen is blown from the lance in a hard blow condition as described above, since the atmosphere in the vacuum vessel is in a low vacuum condition as described above, splashing of the metal in the vacuum vessel can be reduced. Accordingly, this method can be put into practical use.

Next, in the present invention, before the decarburization conducted by blowing oxygen or before the processing conducted in a high vacuum (decarburization or hydrogen removal) or before the composition adjustment conducted by adding alloy, the atmosphere in the vacuum vessel is maintained in a low degree of vacuum, and Al alloy is charged into the vacuum vessel, and then oxygen is fed from the top-blowing lance. In the atmosphere described above, carbon is seldom oxidized. Accordingly, oxygen can be effectively utilized for oxidizing Al, and particles of $Al_2O_3$ can be easily discharged outside the vessel. In order to obtain a higher reaction efficiency of Al alloy, it is preferable to blow oxygen gas from the top-blowing lance in a hard blow condition so that the cavity depth can be 50 to 400 mm.

Next, in the present invention, before the adjustment of composition by adding alloy conducted after decarburization, the atmosphere in the vacuum vessel is maintained in a low degree of vacuum of 120 to 400 Torr, and a desulfurizing agent, the primary component of which is quick lime, is charged from the top-blowing lance into the vacuum vessel together with carrier gas. According to the above method, when the concentration of "T.Fe+MnO" of converter slag outside the vacuum vessel is lowered, the desulfurizing reaction of the molten steel in the vacuum vessel can be facilitated, and further the desulfurizing agent in the molten steel can be easily made to flow out from the vacuum vessel. Due to the foregoing, the basicity of slag outside the vacuum vessel can be increased, so that rephosphorization can be prevented. Therefore, the desulfurizing treatment can be very effectively performed.

Next, in the present invention, while the composition is being adjusted by adding alloy, the atmosphere in the vacuum vessel is maintained in a low degree of vacuum of 100 to 400 Torr, and combustion improving gas of hydrocarbon such as LPG and oxygen gas are blown out from the top-blowing lance, so that a burner can be formed and the molten steel is heated by the thus formed burner. In this way, the temperature of molten steel can be adjusted and the metal can be prevented from adhering to the vacuum vessel.

By the above method, it is possible to reduce the height of the lance, so that heat can be highly effectively transferred to the molten steel. Further, when the convection heat transfer is caused as well as the radiation heat transfer, the heat transfer efficiency can be more enhanced.

It should be noted that the present invention includes a case in which the above processes are combined with each other so as to refine molten steel.

BEST MODE FOR CARRYING OUT THE INVENTION

The molten steel refining method of the present invention now will be explained in detail.

According to the method of the present invention, molten steel subjected to decarburization by a converter is refined.

In the straight barrel type vacuum refining apparatus used for the present invention, no vessel bottom is provided in the molten steel dipping portion of the vacuum vessel. Accordingly, even in a low degree of vacuum (when the vacuum is measured in the unit Torrs, the Torr number is large), it is possible to blow oxygen from a top-blowing lance.

Figure 1:
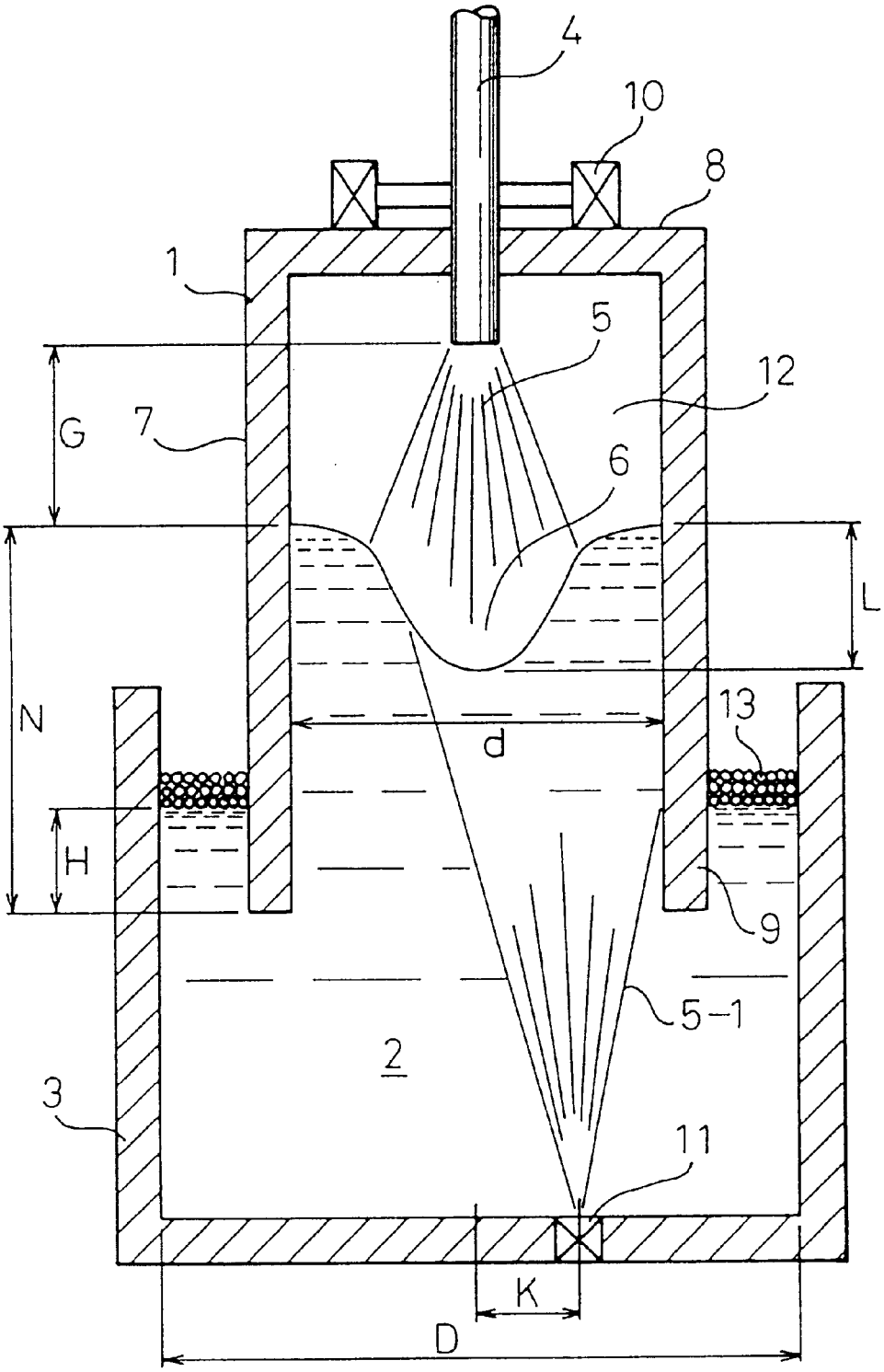
FIG. 1 is a sectional front view of a straight barrel type vacuum refining apparatus illustrating its general construction in accordance with the present invention.

Referring to FIG. 1, the refining apparatus of the invention will be explained below.

In the drawing, molten steel 2 is held in a ladle 3. A lower portion of the cylindrical barrel 7 of the vacuum vessel 1 is dipped in the molten steel 2, so that a dipping portion 9 can be formed. A ceiling 8 is provided in the upper portion of the cylindrical barrel 7. A lower portion of the cylindrical barrel 7 is open. Accordingly, no vessel bottom is provided at the lower portion of the cylindrical barrel 7. The lower portion of the cylindrical barrel 7 is formed into a cylindrical shape.

In the ceiling 8, there is provided a holding device 10 for holding a top-blowing lance. By this holding device 10, the top-blowing lance 4 is held and moved upward and downward so that the distance from the lance to the molten steel surface can be maintained appropriately.

Porous bricks 11 are provided at the bottom of the ladle 3. The porous bricks 11 are arranged at a position distant from the bottom center by a distance K. For example, Ar gas 5-1 is blown toward a space 12 of the cylindrical barrel portion 7 via these porous bricks 11. The position at which Ar is blown deviates from the center of the bottom of the ladle. Accordingly, a current of Ar gas deviates from the center, and a bubble activating surface is formed in a portion on the surface of molten steel. In this case, the bubble activating surface is defined as an activating surface formed when bubbles of a gas, which has been blown into molten steel, rise and appear on the surface. When Ar gas is blown into the molten steel while it deviates from the center of the bottom of the ladle, one portion of molten steel in the barrel portion is pushed up, and the other portion where Ar gas is not blown is lowered. As a result, molten steel circulates between the ladle 3 and the cylindrical barrel 7 of the vacuum vessel.

A current of oxygen gas 5 is jetted into the circulating molten steel 2 from the water cooled lance 4 inserted from the ceiling 8 of the vacuum vessel into the vacuum vessel, so that a cavity (recess) 6 is formed on the surface of molten steel. A slag layer 13 is formed on the surface of molten steel between the inner wall of the ladle 3 and the outer wall of the dipping portion 9 of the cylindrical barrel portion 7. A vacuum device (not shown) is connected with the vacuum vessel 1, and the vacuum of the atmosphere in the space 12 of the barrel portion 7 is adjusted to be a predetermined value.

The vacuum refining apparatus of this embodiment has a straight barrel type vacuum vessel, the dipping portion of which has no vessel bottom. In the case of refining molten steel, the carbon concentration of which has been adjusted to be not more than 0.1% by means of decarburization conducted in a converter, it is possible to blow oxygen gas even if the degree of vacuum is low, because the straight barrel type vacuum vessel has no bottom. When oxygen gas is blown into molten steel by means of top-blowing in the above apparatus, it is necessary that the blowing operation is conducted in a low vacuum condition to facilitate the decarburizing reaction. The decarburizing reaction performed by top-blown oxygen in a region where the carbon concentration is not more than 0.1% proceeds in the following manner. Since the carbon concentration is low, top-blown oxygen temporarily generates iron oxide, and the thus generated iron oxide reacts with carbon contained in molten steel. Accordingly, in order to make the reaction proceed effectively, the following three factors are important.

(1) Iron oxide, which has been generated on the surface, is dispersed into fine particles, so that the reacting surface area can be increased.

(2) Iron oxide is made to be pure FeO so as to enhance the activity and ensure the reaction property.

(3) Feed of carbon from the molten steel bulk to the reaction site is facilitated.

Factor (3) is influenced by the stirring and mixing conducted by gas blown to the molten steel from a lower position. When oxygen gas is blown in a high degree of vacuum, bubbles of gas grow while they are rising onto the surface. Therefore, the agitating energy increases. When the degree of vacuum is lower than 195 Torr, the stirring energy decreases, and the molten steel is not stirred and mixed sufficiently, so that the carbon feed speed is lowered when carbon is fed from the molten steel bulk to the reaction site. As a result, the decarburizing efficiency is deteriorated. Also, factor (1) is determined by a relation between the impinging surface of top-blown oxygen and the bubble activating surface. That is, iron oxide is generated on the impinging surface of top-blown oxygen. On the other hand, an iron oxide layer generated on a large bubble activating surface is formed in such a manner that individual bubbles of gas are dispersed into fine particles when bubbles of gas blown from a lower position rise and appear on the surface. Accordingly, it is preferable that an overlapping region of the impinging surface of top-blown oxygen and the bubble activating surface is not less than 50% of the impinging surface of top-blown oxygen. Factor (2) is greatly influenced by the removal property of converter slag mixed into the vacuum vessel before the processing. That is, when converter slag exists on the surface of molten steel provided in the vacuum vessel, iron oxide generated in the process of blowing oxygen by means of top-blow is mixed with the converter slag, and the concentration of FeO is remarkably reduced. In this case, the reacting property of FeO with C is greatly deteriorated, and the decarburizing efficiency is remarkably lowered. In order to discharge the converter slag from the vacuum vessel, it is necessary to maintain the vacuum vessel in a low degree of vacuum. The reason is described as follows. When the vacuum vessel is maintained in a high degree of vacuum (when the vacuum is measured in the unit Torrs, the Torr number is small), an interval between the lower end of the dipping portion and the surface of molten steel in the vacuum vessel is increased, and although slag particles in the molten steel on the surface are moved downward by being carried by a stream of molten steel going downward, few particles reach the lower end of the dipping portion, and most particles only circulate in the vacuum vessel. The above slag particles rise on the bubble activating surface being carried by a stream of molten steel going upward. Accordingly, the above slag particles are mixed with iron oxide generated by top-blown oxygen, so that the concentration of FeO is lowered. On the other hand, when the vacuum vessel is maintained in a low vacuum condition, the degree of vacuum of which is not less than 105 Torr, the distance between the lower end of the dipping portion and the surface of molten steel in the vacuum vessel is decreased. Therefore, slag particles in the molten steel on the surface are moved downward being carried by a stream of molten steel going downward, so that they can be easily made to flow out from the lower end of the dipping portion to the outside of the vacuum vessel. As a result, almost all slag can be discharged from the vacuum vessel in a short period of time. Therefore, iron oxide generated by top-blown oxygen can remain in the form of pure FeO. Consequently, it is possible to keep the decarburizing oxygen efficiency high.

Figure 2:
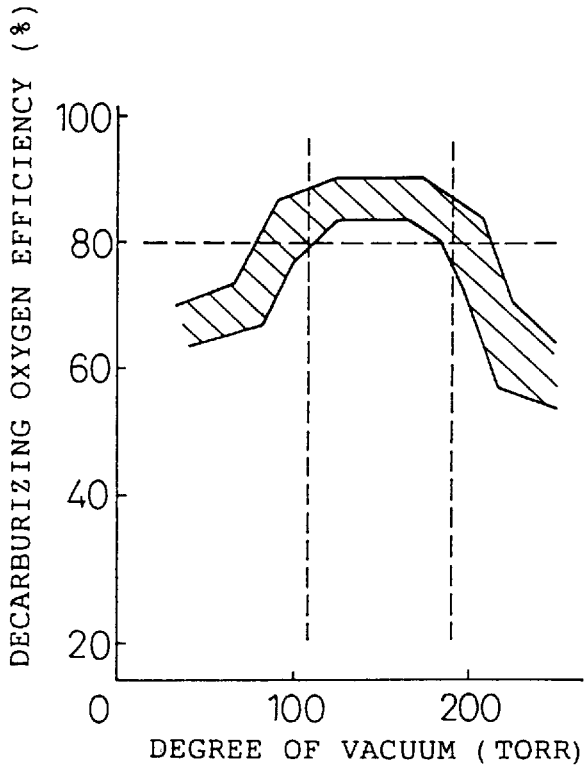
FIG. 2 is a graph showing a relation between the degree of vacuum and the decarburizing oxygen efficiency.

Due to the foregoing, as shown in FIG. 2, it is possible to obtain a decarburizing oxygen efficiency of not less than 80% in a region where the vacuum is 105 to 195 Torr.

It is preferable that a distance N from the lower end of the dipping portion to the surface of molten steel in the vacuum vessel is set at 1.2 to 2 m. The above distance 1.2 to 2 m is the condition necessary for making the oxide generated on the surface of molten steel in the vacuum vessel flow out outside the vessel effectively. When the distance N is shorter than 1.2 m, oxide flows outside the vessel in a short period of time. Therefore, the residence time (reaction time) in the molten steel is short, and there is a high possibility that the oxide flows outside the vessel before the completion of reaction. When the distance N is longer than 2 m, a flow speed of the stream going downward is lowered at a position close to the lower end of the dipping portion. Accordingly, it is difficult for the oxide to flow out from the vacuum vessel.

However, when a reducing speed, i.e., the chemical reaction speed of iron oxide conducted by top-blown oxygen is low, even if the degree of vacuum is appropriate, it is difficult to make progress in the reduction of iron oxide, and the decarburizing oxygen efficiency can not be enhanced. Since the reducing reaction speed is substantially determined by temperature, the temperature in a impinging region (hot spot) in which an oxygen jet impinges with molten steel is important, wherein the generated iron oxide is mainly reduced in this impinging region. Accordingly, in order to enhance the decarburizing efficiency, it is necessary to conduct a hard blow operation so as to raise the hot spot temperature. Concerning the condition of the hard blow operation, the depth of a cavity formed on the molten steel surface by an oxygen jet is made to be 150 to 400 mm.

Figure 3:
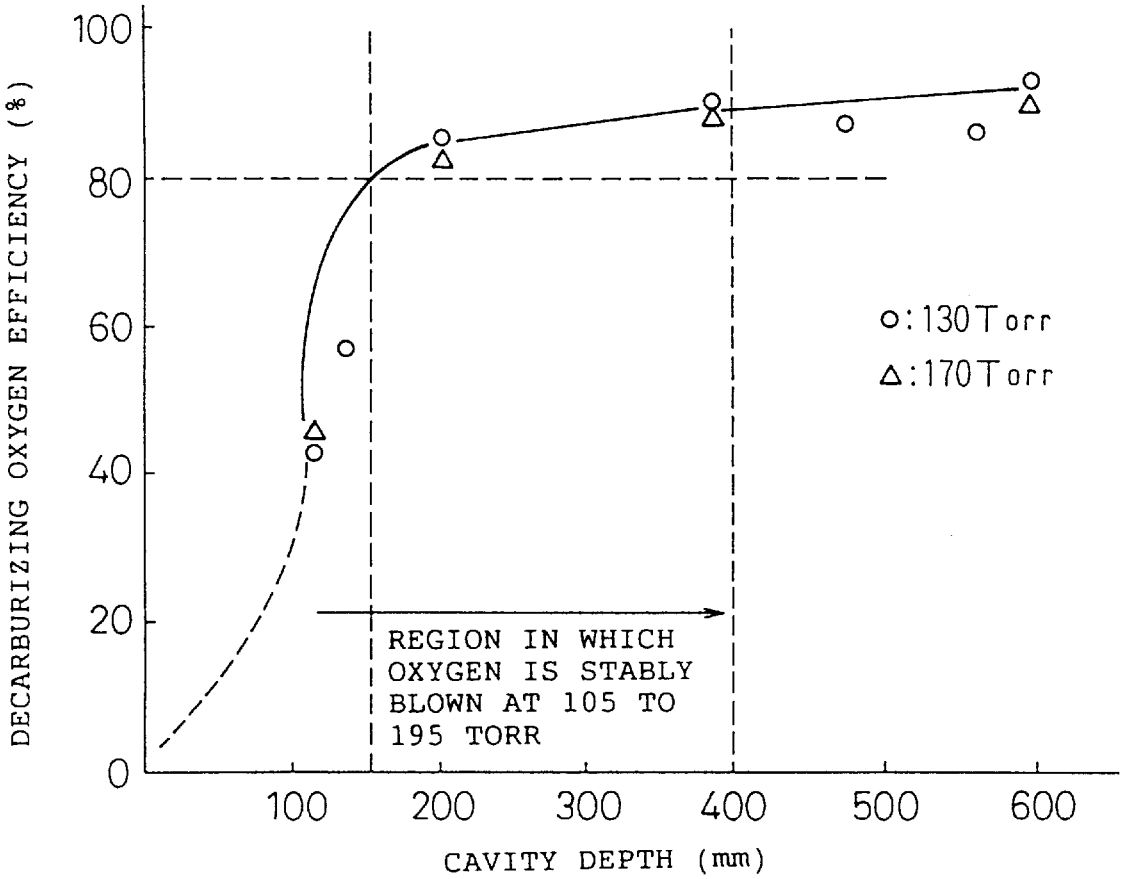
FIG. 3 is a graph showing a relation between the cavity depth and the decarburizing oxygen efficiency.

As illustrated in FIG. 3, when the cavity depth is not less than 150 mm, the decarburizing oxygen efficiency can be made to be not less than 80%.

The most serious problem caused when oxygen is blown into a low degree of vacuum atmosphere in the hard blow operation is the occurrence of splash. Conventionally, it is considered that the splash of molten steel occurs when molten steel is dispersed by the kinetic energy of top-blown oxygen gas. Therefore, it is considered that the occurrence of splash can be prevented only when the kinetic energy of molten steel is suppressed by conducting a very soft blowing operation. Also, it is considered that the occurrence of splash can be prevented only when the dispersing direction of splash is changed from the outward to the inward by extremely increasing the depth of the cavity in a very hard blow operation. The aforementioned methods are common when molten steel is refined in a converter. However, the oxygen blowing speed of the present invention is much lower than that of refining molten steel in a converter. Therefore, it is difficult to realize a very hard blowing operation in the present invention. For this reason, it is considered that the occurrence of splash can be avoided only when a very soft blowing operation is conducted.

However, the present inventors made an investigation located the behavior of occurrence of splash when the oxygen blowing speed was low. As a result of the investigation, it was found that it is possible to suppress the occurrence of splash even if the cavity depth is 150 to 400 mm. That is, when the oxygen blowing speed is originally low so that the possibility of occurrence of splash is low, the amount of splash caused when oxygen gas is blown is not influenced by the kinetic energy of oxygen gas but it is influenced by other factors. The primary cause of splash is described as follows. Top-blown oxygen of impinge with molten steel at the hot spot. At this time, iron oxide particles are generated at the hot spot. When these iron oxide particles are located below the surface of molten steel and reacted with carbon in the molten steel, CO gas is generated. When CO gas is generated in this way, splash is caused. In the case of a very soft blowing operation, even if iron oxide particles are generated at the hot spot on the molten steel surface, the downward kinetic energy of top-blown oxygen gas is low, so that the iron oxide particles can not intrude into the molten steel, and the reaction occurs only on the molten steel surface. Therefore, drops of molten steel are not generated even when CO gas is generated. Conventionally, the refining operation has been carried out in this region.

When a hard blowing operating condition is adopted as compared with the above operating condition, the iron oxide particles generated at the hot spot intrude into molten steel due to the downward kinetic energy of the top-blown oxygen gas. Accordingly, CO gas is generated in the molten steel, and splash occurs. For the reasons described above, it is considered that splash occurs when the blowing operating condition is harder than the conventional one.

However, when the operating condition is made to be a hard blowing condition which is harder than the conventional hard blowing operating condition, the heat inputting speed per unit area is increased, and the temperature at the hot spot is raised. Accordingly, the reducing speed of iron oxide is increased, and iron oxide generated on the surface of molten steel at the hot spot is reduced by [C] in the molten steel in a very short period of time. Therefore, a steady entrapment of iron oxide into the molten steel can be avoided. As a result, no CO gas is generated in the molten steel, so that the occurrence of splash can be decreased. Concerning the decrease in splash, the critical condition is that the cavity depth is not less than 150 mm. When the operating condition is made to be a hard blow condition which is harder than the above condition, drops of molten steel are dispersed by the kinetic energy of top-blown oxygen gas in the same manner as that of refining operation conducted in a converter. Therefore, the amount of splash caused in the refining process is increased. The critical condition is that the cavity depth is not more than 400 mm.

Figure 4:
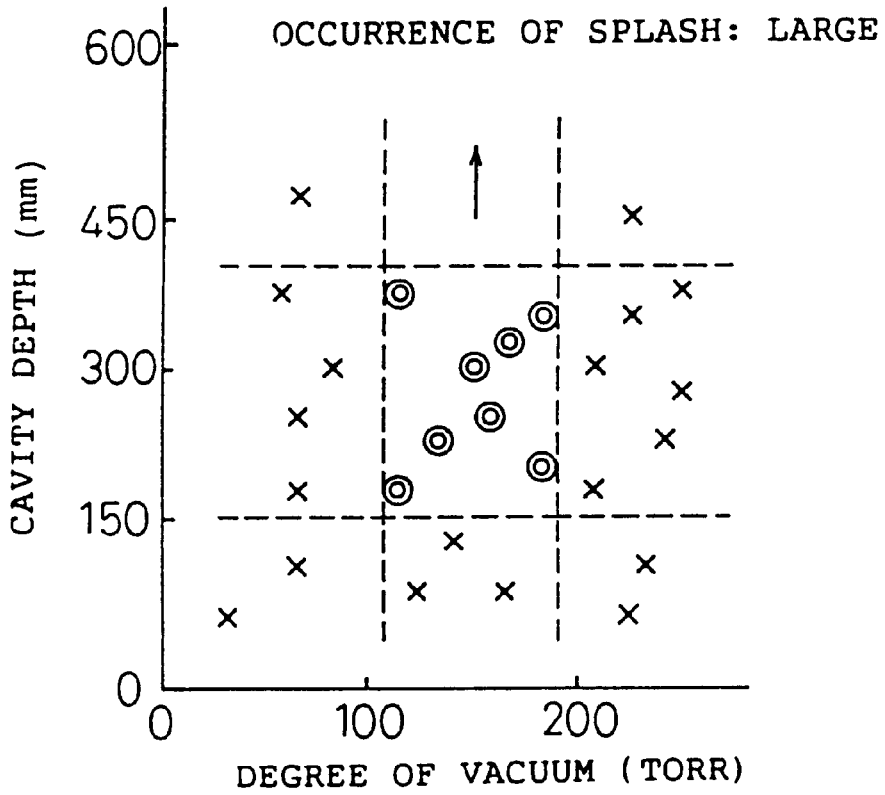
FIG. 4 is a graph showing a relation between the degree of vacuum and the cavity depth, wherein the most appropriate decarburizing condition is shown.
Figure 5:
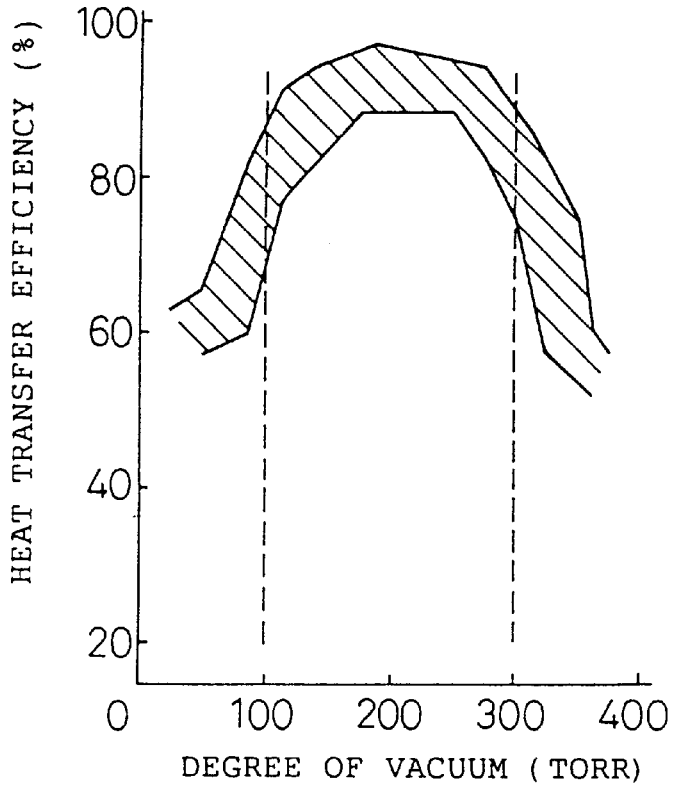
FIG. 5 is a graph showing a relation between the degree of vacuum and the heat transfer efficiency of aluminum heating.

In other words, an upper limit of the cavity depth by which the occurrence of splash can be reduced and oxygen gas can be blown stably, the degree of vacuum of which is 105 to 195 Torr, is 400 mm as illustrated in FIG. 4.

Accordingly, in the present invention, the cavity depth is limited to a range from 150 to 400 mm, the degree of vacuum of which is 105 to 195 Torr. In this connection, mark ○ in FIG. 3 represents an example in which the degree of vacuum is set at 130 Torr, and mark Δ represents an example in which the degree of vacuum is set at 170 Torr.

In this case, cavity depth L (mm) is computed by the following equations.

$$L=L_n\cdot\exp(-0.78G/L_n) \quad (1)$$

In the above equation, $L_n$ is defined by the following equation.

$$L_n=63(F/(n\cdot d_N))^{2/3} \quad (2)$$

where F is a gas feed speed ($Nm^3/Hr$), n is a number of nozzles, $d_N$ is a diameter of the nozzle throat (mm), and G is a distance (mm) from the lance end to the surface of molten steel in the vacuum vessel.

In this case, when the cavity depth is smaller than 150 mm, the hot spot temperature is not sufficiently high. Therefore, even if the degree of vacuum is appropriate and substantially pure iron oxide is generated, the reducing reaction speed is low, so that the decarburizing oxygen efficiency is low. To the contrary, when the cavity depth is larger than 400 mm, the kinetic energy of the top-blown oxygen gas is too high. Accordingly, metal is dispersed, that is, splash is caused. Therefore, it is impossible to put this operating condition into practical use.

In the case where ultra low carbon steel is produced in the refining process, after the completion of decarburization conducted by blowing oxygen, the degree of vacuum in the vacuum vessel is enhanced, and the refining process is transferred to the decarburization conducted in a high degree of vacuum. The decarburization conducted in a high degree of vacuum is performed by utilizing a reaction conducted between oxygen and carbon melted in molten steel. In this case, a reaction on the free surface exposed to vacuum is important. Accordingly, when the free surface is covered with slag, the reaction speed is greatly reduced, and further slag is explosively scattered by the action of CO gas generated in accordance with a decrease in pressure. That is, a phenomenon of bumping is caused, which produces a serious problem in the refining operation. In order to avoid the occurrence of the above problem, it is necessary to discharge the entire slag, the primary component of which is iron oxide generated in the process of decarburization conducted by blowing oxygen, outside the vacuum vessel before the start of high vacuum treatment. In order to discharge the entire slag outside the vacuum vessel, it is necessary to reduce the dipping depth of the dipping portion by 0.2 H to 0.6 H, wherein H is a distance (dipping depth) from the lower end of the dipping portion to the surface of molten steel outside the vacuum vessel in a period of the decarburization conducted by blowing oxygen gas. Due to the foregoing, since a static hydraulic pressure (a head) given by the molten steel outside the vacuum vessel lowers, the slag particles which have arrived at the lower end of the dipping portion being carried by a stream of molten steel going downward, can be more easily discharged outside the vacuum vessel. When the dipping depth is larger than 0.6 H, the dipping depth momentarily becomes zero in some portions when the surface of molten steel outside the vacuum vessel oscillates. Since the outside air is sucked into the vacuum vessel in this case, the concentration of nitrogen in molten steel is increased. When the dipping depth is smaller than 0.2 H, the head is not sufficiently low. Therefore, it is impossible to discharge the entire slag outside.

Next, Al heating of molten steel will be explained as follows.

In order to accomplish Al heating at a high efficiency in which Al added to molten steel is burned in top-blown oxygen gas so as to raise the temperature of molten steel, it is necessary to maintain the vacuum vessel in an appropriate degree of vacuum, and it is also necessary to blow oxygen gas by a hard blow operation.

Figure 6:
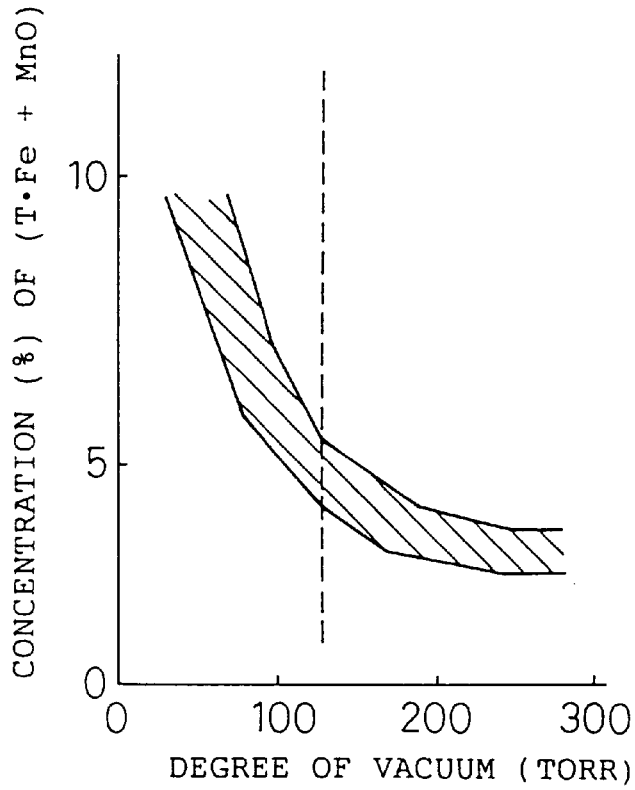
FIG. 6 is a graph showing a relation between the degree of vacuum and the concentration of (T.Fe+MnO).

The present inventors made experiments on Al heating to investigate it. As a result of the experiments, as shown in FIG. 6, it was found that the heat transfer efficiency of Al heating was not less than 80% when the degree of vacuum was maintained in a range from 100 to 300 Torr.

In the case of a high vacuum condition in which the degree of vacuum is lower than 100 Torr, the oxidizing reaction of carbon occurs together with the oxidization of Al. Therefore, the utilization efficiency of oxygen is lowered, and further it is difficult to discharge $Al_2O_3$ which has been generated in the above oxidizing reaction. Accordingly, the heat transfer efficiency is deteriorated. On the other hand, in the case of a low vacuum condition in which the degree of vacuum is higher than 100 Torr, the decarburizing reaction seldom occurs. Accordingly, the oxygen utilization efficiency is high in the oxidization of Al. Further, since the interval N between the lower end of the dipping portion and the surface of molten steel in the vacuum vessel becomes small, particles of $Al_2O_3$ in molten steel on the surface are moved by a current of molten steel going downward, so that they can easily flow outside the vacuum vessel. Therefore, the heat transfer efficiency can be maintained high. In the case of a low vacuum condition in which the degree of vacuum is higher than 300 Torr, the amount of circulating molten steel is lowered, so that the heat transfer efficiency is deteriorated.

It is preferable that the distance N between the lower end of the dipping portion and the surface of molten steel in the vacuum vessel is 1.2 to 2 m. The above condition is necessary for making the oxide generated on the surface of the vacuum vessel flow outside the vessel effectively. When the distance N is shorter than 1.2 m, the oxide flows outside the vessel in a short period of time. Therefore, the residence time (reaction time) in molten steel is short, and most of the oxide flows out before the heat of $Al_2O_3$ particles is sufficiently transferred to molten steel. When the distance N is longer than 2 m, a flow speed of the current of molten steel going downward is decreased at the lower end of the dipping portion. Accordingly, it becomes difficult for the oxide to flow outside the vessel.

According to the investigation made by the inventors, it was found that a higher reaction efficiency was obtained when a hard blowing operation was conducted. When oxygen gas is blown by means of top-blowing in the above appropriate vacuum condition, the oxidizing reaction of Al melted in the molten steel is conducted in such a manner that a coat of $Al_2O_3$ is generated on the surface of molten steel with which the top-blown oxygen gas has collided. This coat of $Al_2O_3$ is crushed by the downward kinetic energy of the top-blown oxygen gas and suspended in the molten steel. However, in the case where the kinetic energy of the top-blown oxygen gas is low, the coat of $Al_2O_3$ can not be crushed by the top-blown oxygen but it is crushed by a current of bottom-blown gas which goes upward. Accordingly, the thus crushed $Al_2O_3$ is not suspended in molten steel but it temporarily rises up to the surface of molten steel. As described above, in the case where the kinetic energy of top-blown oxygen gas is not sufficiently high, it is difficult for $Al_2O_3$ to be suspended in molten steel. Accordingly, even if the degree of vacuum is appropriate, $Al_2O_3$ accumulates on the surface, and the heat transfer efficiency is lowered. For the above reasons, the downward kinetic energy of top-blown oxygen gas must be sufficiently high to form a cavity, the depth of which is 50 to 400 mm, on the surface of molten steel by the oxygen jet. In this case, the cavity depth L (mm) is computed by the above equations (1) and (2).

When the cavity depth is larger than 400 mm, the kinetic energy of top-blown oxygen gas becomes too high, so that the amount of splash is increased. Accordingly, a cavity depth larger than 400 mm is not appropriate for practical use.

In the case of refining a ultra low carbon steel or in the case of conducting hydrogen removal, after Al heating has been completed, the degree of vacuum is increased, and decarburization and hydrogen removal are conducted in a high vacuum condition. Decarburization is conducted in a high vacuum condition by utilizing a reaction of oxygen melted in molten steel with carbon. Hydrogen removal is also conducted by utilizing a reaction of hydrogen melted in molten steel. Therefore, a reaction conducted on the free surface exposed to the vacuum is important. Accordingly, when the free surface is coated with slag, the reaction speed is greatly reduced, and further slag is explosively scattered by the action of CO gas generated in accordance with a decrease in pressure. That is, a phenomenon of bumping is caused, which causes a serious problem in the refining operation. In order to avoid the occurrence of the above problems, it is necessary to discharge the entire slag completely, the primary component of which is $Al_2O_3$ generated in the process of Al heating, outside the vacuum vessel before the start of decarburization refining and high vacuum processing. In order to discharge the entire slag outside the vacuum vessel, it is necessary to reduce the dipping depth of the dipping portion by 0.2 H to 0.6 H, in a period of Al heating for the same reason as that of refining a ultra low carbon steel. In this way, the entire slag can be easily discharged outside the vacuum vessel.

Next, a method of desulfurization conducted in a reduced pressure will be explained below.

Concerning the desulfurizing reaction, the deoxidizing reaction conducted by a desulfurizing agent added into the vacuum vessel must be considered, and at the same time, the sulfurizing reaction conducted when oxygen is fed from converter slag, the iron oxide concentration of which is high, must be considered. That is, since the desulfurizing reaction formula can be described as [S]+CaO CaS+[O], in order to make the desulfurizing processing proceed effectively, it is indispensable to sufficiently lower the concentration of [O] expressed on the right side. In order to make the desulfurization processing proceed effectively, in the process of deoxidation conducted before the desulfurization processing, it is important to sufficiently lower the oxygen potential (T.Fe+MnO) in the converter slag outside the vacuum vessel. However, when the oxygen potential in the converter slag is sufficiently lowered, phosphorus oxide contained in the converter slag becomes unstable in the process of desulfurization, so that the concentration of phosphorus in molten steel is increased, that is, a phenomenon of rephosphorization reaction occurs. In order to suppress the occurrence of the rephosphorization reaction, it is necessary to increase the concentration of CaO in the converter slag outside the vacuum vessel, the oxygen potential of which is lowered in the process of desulfurization, so that the basicity of the converter slag can be enhanced and the phosphorus oxide can be stabilized even if the oxygen potential is low.

That is, in order to conduct the desulfurization effectively and suppress the rephosphorizing reaction, the following two factors are required.

(1) Concerning the converter slag outside the vacuum vessel, the concentration of (T.Fe+MnO) is sufficiently lowered in the process of deoxidation.

(2) Concerning the converter slag outside the vacuum vessel, the basicity is enhanced in the process of desulfurization.

The above two conditions can be satisfied when the vacuum is kept at 120 Torr. That is, when the vacuum is low, a distance between the lower end of the dipping portion and the surface of molten steel in the vacuum vessel is decreased. Therefore, the following two characteristics are exhibited.

(A) When gas is blown from a lower position into the vacuum vessel, a wave motion on the surface of molten steel in the vacuum vessel can be easily transmitted to the molten steel outside the vacuum vessel.

(B) After a desulfurizing agent, the principal component of which is quick lime fed onto the surface of molten steel in the vacuum vessel, has been suspended into the molten steel, it can be easily made to flow out from the lower end of the dipping portion to the outside of the vacuum vessel. In this case, characteristic (A) greatly affects the factor (1) described before. Since the molten steel outside the vacuum vessel is also agitated, the reaction speed of Al melted in the molten steel with the slag outside the vacuum vessel is increased. Accordingly, the concentration (T.Fe+MnO) of the converter slag outside the vacuum vessel is effectively lowered to a value not more than 5% in a short period of time as illustrated in FIG. 6.

On the other hand, in the case of a high vacuum condition in which the degree of vacuum is lower than 120 Torr, the molten steel outside the vacuum vessel seldom flows so that the stirring can not be conducted strongly, and Al melted in the molten steel seldom reacts with the slag outside the vacuum vessel. Characteristic (B) considerably affects the factor (2). That is, during the desulfurizing processing, a desulfurizing agent, the principal component of which is quick lime fed onto the molten steel surface in the vacuum vessel, flows out from the lower end of the dipping portion to the outside of the vacuum vessel being carried by a current of molten steel going downward. Accordingly, the basicity of the slag outside the vacuum vessel is increased in accordance with the progress of processing. Therefore, the rephosphorization reaction can be prevented. On the other hand, in the case of a high vacuum condition in which the degree of vacuum is lower than 120 Torr, the desulfurizing agent seldom flows outside the vacuum vessel. Therefore, the basicity of the slag outside the vacuum vessel is not raised, and the rephosphorization reaction can not be avoided.

In the case of a low vacuum condition in which the degree of vacuum is higher than 400 Torr, bubbles of gas blown into the molten steel blow up greatly, so that the stirring energy is decreased. Accordingly, the molten steel is not stirred and mixed sufficiently, and the desulfurizing efficiency is deteriorated.

Next, the present inventors made experiments in which a straight barrel type vacuum refining apparatus was used as follows. Under the condition that the renewal speed of molten steel was sufficiently high at the blowing position, powder for refining was blown to molten steel. In order to obtain the most appropriate blowing condition so that a high reacting efficiency can be easily provided, a lance of large diameter, which had already been established, was commonly used to blow powder for refining, and blowing was conducted in a low vacuum condition at a low blowing speed. As a result of the above experiments, the following were found. When the renewal speed of molten steel was sufficiently high on the blowing surface and the vacuum condition was low, even if the blowing speed was low, it was possible to obtain a high efficiency of trapping powder and the reaction efficiency was enhanced.

According to the present invention, when the straight barrel type vacuum refining apparatus was used, even in a low vacuum condition in which the degree of vacuum was not less than 120 Torr, it was possible to ensure an activating effect on the molten steel surface provided by the circulating gas sent from the ladle bottom, and it was also possible to ensure a large amount of circulating molten steel. Accordingly, even if the blowing speed of oxygen gas was low, it was possible to obtain a high rate of trapping powder. Specifically, the vacuum refining apparatus was used, and the blowing speed was set in a range from 10 m/sec to Mach 1 in a low vacuum condition in which the degree of vacuum was not less than 120 Torr. In the above operating condition, it was possible to provide a high powder trapping rate.

According to the present invention, the cavity on the molten steel surface was formed when oxygen gas was blown at a blowing speed of 10 m/sec which was the minimum value necessary for trapping powder used for refining. When powder for refining was blown into molten steel at this speed, the amount of powder for refining sucked uselessly into the exhaust gas system was decreased, and it was possible to blow powder for refining into molten steel at a high solid-gas ratio from a common lance.

The depth of intrusion of powder for refining, which was blown to molten steel, is substantially constant irrespective of the flow rate of carrier gas. Accordingly, it is sufficient that the blowing speed of powder for refining is set at the minimum speed by which powder for refining can be sent to a position immediately below the molten steel surface. Although the minimum speed is somewhat different according to the blowing condition, as a result of experiments, it was necessary to maintain the speed at a value not less than 10 m/sec. It was not preferable that the blowing speed was set at a value not less than Mach 1, because molten steel splashed and further the temperature of molten steel dropped.

In the present invention, a straight barrel type vacuum refining apparatus is used. Accordingly, a head of molten steel in the vacuum vessel can be maintained at a sufficiently high value even in a low vacuum condition of not less than 120 Torr. When a large amount of gas is blown from the ladle bottom, the renewal speed on the surface of molten steel in the vacuum vessel is much faster than that of a common degasifying ladle device. For example, when the degree of vacuum is 150 Torr, a difference of the head of molten steel between the inside and the outside of the vacuum vessel is 1.1 m. When the amount of circulating gas sent from the ladle bottom is set at the same value, the renewal speed on the molten steel surface and the circulating speed of molten steel are approximately the same as those in the case of blowing gas in a high vacuum condition. Therefore, even in a low vacuum condition, powder for refining used as a desulfurizing agent, which has been blown into molten steel, can deeply intrude into molten steel in the ladle being carried by this circulating current, so that the reacting efficiency can be enhanced. Since the straight barrel type refining apparatus has no vessel bottom, even in a low vacuum condition, no oxygen gas collides with a barrel bottom unlike the RH type refining apparatus. Accordingly, there is no possibility of damage of refractory material of the vessel bottom.

A molten steel surface arrival speed of carrier gas is computed by the following method.

The Mach number M' in the case of blowing gas from a nozzle is defined by the following equation, where the degree of vacuum is P (Torr) and the back pressure of carrier gas is P' (kgf/cm$^2$). In the following equation, M' exists as an implicit function. Therefore, it is computed as a numerical solution.

$$\frac{P/760}{P_r} = (1.2M')^{3.5} \times \left(\frac{2.4}{28M_r^2 - 0.4}\right)^{2.5} \tag{3}$$

The Mach number M at the time of arrival on the molten steel surface can be computed by the following equation, where G (mm) is a distance from the nozzle end to the molten steel surface in the vacuum vessel, do is a diameter of the nozzle exit, and n is a number of nozzles.

$$M = 6.3M'/(G/\{(n \cdot do^2)^{1/2}\}) \tag{4}$$

The Mach number M is converted into the flow speed U (m/s) at the time of arrival on the molten steel surface by the following equation.

$$U=M\times 320\times 0.07p^{1/2} \quad (5)$$

It is preferable that the distance N from the lower end of the dipping portion to the molten steel surface in the vacuum vessel is set at 1.2 to 2 m. This condition is necessary to make a desulfurizing agent fed onto the molten steel surface in the vacuum vessel effectively flow outside the vessel. When the distance N is shorter than 1.2 m, the desulfurizing agent flows outside the vessel in a short period of time. Therefore, the residence time (reaction time) is short, and most of the desulfurizing agent flows outside before the completion of reaction. When the distance N is longer than 2 m, the flow speed of a current of molten steel going downward is lowered at the lower end of the dipping portion. Accordingly, it is difficult for the desulfurizing agent to flow outside.

The desulfurizing efficiency (X) can be found by the following equation.

$$\lambda = \frac{\ln([S]_1 / [S]_2)}{\text{unit consumption of desulfurization agent (kg/t)}} \quad (6)$$

where $[S]_1$ is a concentration [S] (ppm) before processing, and $[S]_2$ is a concentration [S] (ppm) after processing.

Next, the operation of burner heating conducted when molten steel is refined in the straight barrel type vacuum refining apparatus will be explained. In the burner heating after the completion of decarburizing processing or high vacuum processing (including desulfurizing processing), oxygen gas and a combustion improving gas of a hydrocarbon, such as LNG, are jetted out onto the molten steel surface from a top-blowing lance, so that the molten steel and the vacuum vessel can be heated.

In the burner heating described above, while the atmosphere in the vacuum vessel is maintained in a low vacuum condition of 100 to 400 Torr and a distance from the end of the lance to the molten steel surface in the vacuum vessel is adjusted in a range from 3.5 to 9.5 m, the aforementioned combustion gas is blown onto the molten steel surface.

Even in the low vacuum condition described above, when the refining apparatus of the present invention is used, molten steel can be sufficiently stirred and mixed. Accordingly, it is possible to heat the molten steel while the lance height is kept low as described above. Therefore, it is possible to provide a high heat transfer efficiency. According to the prior art, when the degree of vacuum is higher than that of the present invention, only radiation heat transfer occurs. On the other hand, according to the present invention, not only radiation heat transfer but also convection heat transfer occurs. Therefore, the heat transfer efficiency can be further enhanced.

In a low vacuum condition in which the degree of vacuum exceeds 400 Torr, bubbles of gas blown into molten steel expand greatly. Accordingly, the stirring energy is decreased. Due to the foregoing, the molten steel can not be stirred and mixed sufficiently, and the heat transfer efficiency is lowered.

As described above, the characteristic of the present invention can be summarized as follows. In a straight barrel type vacuum refining apparatus, in an atmosphere of a low vacuum condition of 100 to 400 Torr, oxygen gas is blown onto the surface of molten steel by means of top-blowing in an oxygen blowing condition appropriate for each processing. In this case, the oxygen blowing condition is represented by the depth of a cavity formed in the molten steel. The objects of blowing oxygen gas in this vacuum vessel by means of top-blowing are described as follows. The first object is "decarburization" in which oxygen gas is reacted with carbon contained in the molten steel when oxygen gas is blown. The second object is "Al heating" in which the temperature of molten steel is raised when Al added to molten steel is burned by oxygen gas blown into the molten steel by means of top-blowing. The third object is "desulfurization" in which a flux, such as lime, is added together with carrier gas. The fourth object is "burner heating" in which oxygen gas and combustion improving gas of hydrocarbon, such as LNG, are blown by means of top-blowing so as to heat the vacuum vessel and suppress the adhering metal.

Figure 7:
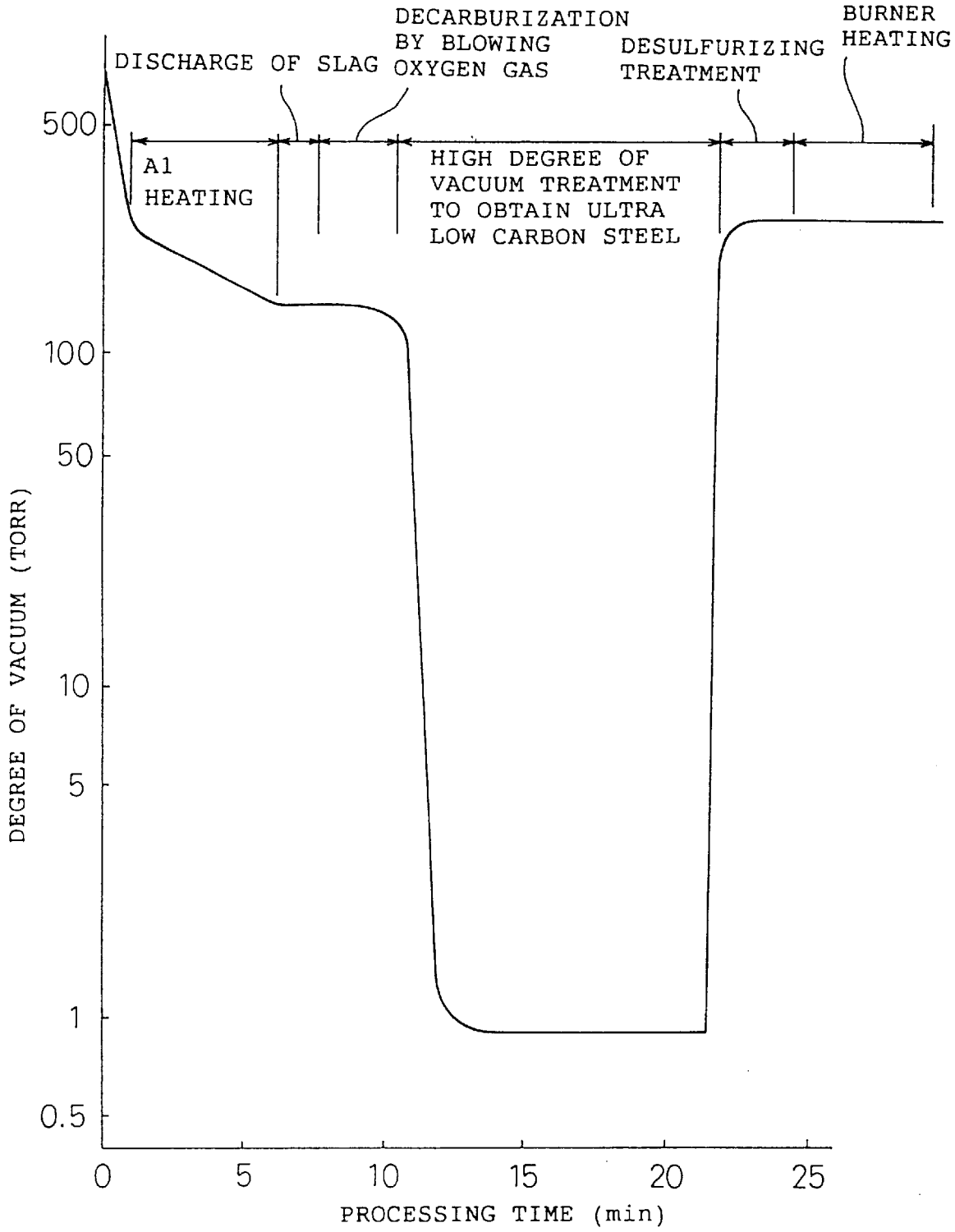
FIG. 7 is a graph showing a relation between the degree of vacuum and the processing time in each process.
Figure 8:
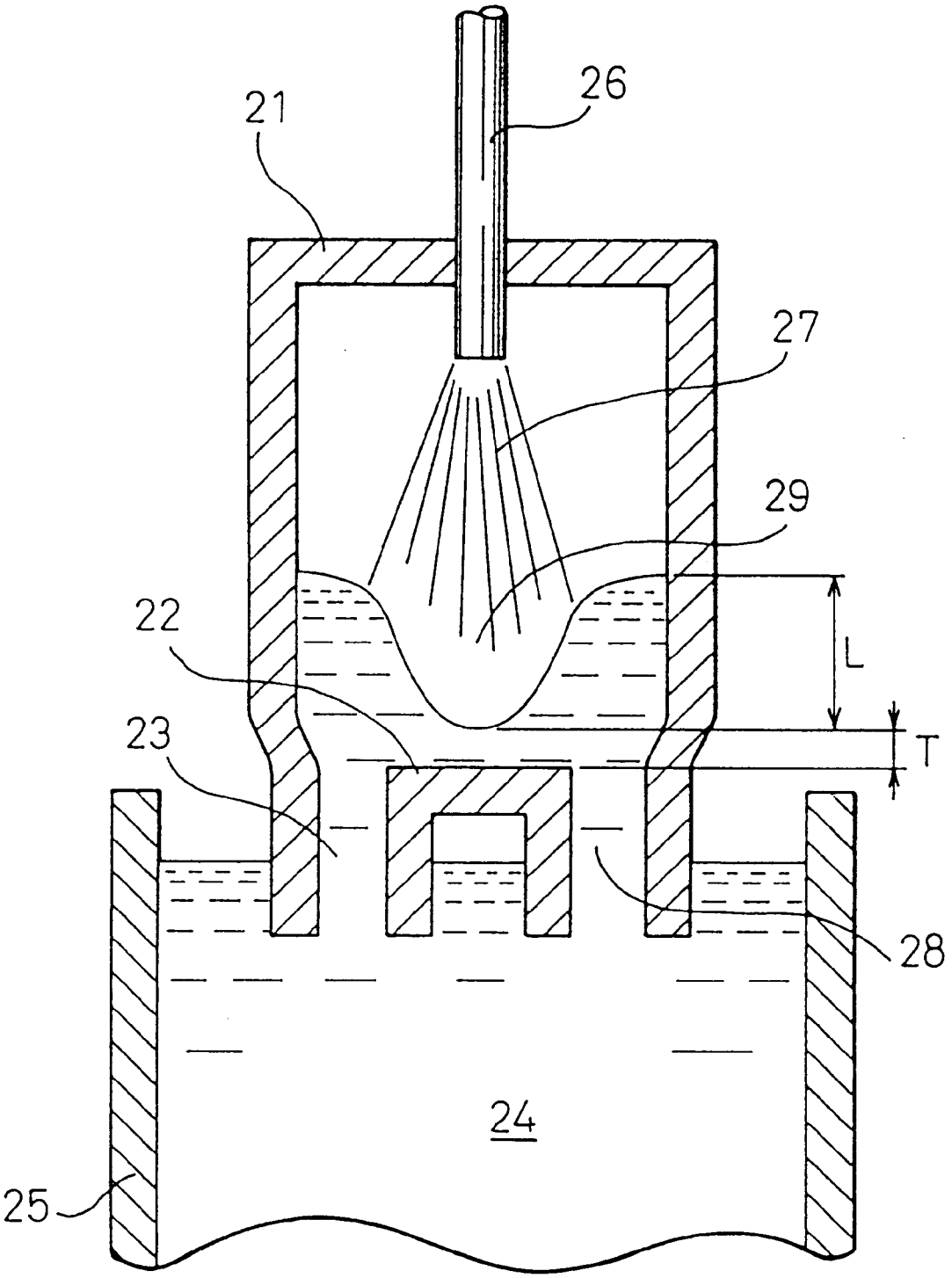
FIG. 8 is a sectional front view of a conventional RH type vacuum refining apparatus illustrating its general construction.

FIG. 7 is a graph showing the combination of each processing described above. In FIG. 7, each processing is expressed by the processing time and the vacuum. In the actual operation, each processing is appropriately combined if necessary.

EXAMPLES

Example 1

In Example 1, while the straight barrel type vacuum refining apparatus shown in FIG. 1 was used, the decarburizing operation was carried out by means of top-blowing. In this case, the capacity of a ladle was 350 ton, the inner diameter D of the ladle was 4400 mm, the diameter d of a dipping portion of the vacuum vessel was 2250 mm, the eccentric distance K of a porous plug from a center of the ladle was 610 mm, and the throat diameter of a top-blowing lance was 31 mm. Concerning the operating condition, the distance G from the lance to the molten steel surface was set at 3.5 m, and the oxygen blowing speed was set at 3300 $Nm^3/h$. Under the above condition, oxygen blowing was carried out for 2 minutes after 2 minutes had passed from the start of processing. Due to the above operation, the concentration of carbon was lowered from 450 ppm to 150 ppm. After that, degassing processing was carried out. In this operation, the depth L of a cavity formed in the process of blowing oxygen gas was 205 mm. A flow rate of Ar gas blown by means of bottom-blowing was 1000 Nl/min which was maintained constant. The degree of vacuum at the start of blowing oxygen gas was 165 Torr, and the degree of vacuum at the end of blowing oxygen gas was 140 Torr. At this time, the distance N from the lower end of the dipping portion to the surface of molten steel in the vacuum vessel was 1750 mm, and the depth H of the dipping portion of the vacuum vessel was 450 mm.

As a result of the above operation, the decarburizing oxygen efficiency $\eta$ was raised to 85%, and there was no adhering metal.

After the above operation, the vacuum vessel was raised and its dipping depth H was set at 230 mm. Then the molten steel was stirred for 2 minutes to further conduct a decarburizing processing in a high vacuum condition. Due to the above processing, as compared with a case in which the dipping depth H was 450 mm, it was possible to shorten the processing time to lower the carbon concentration to 20 ppm by 3 minutes. Next, under the operating condition shown on the first table, the operation was carried out. In this case, as a common condition, the oxygen gas blowing speed was set at 3000 $Nm^3/h$, and the blowing time was set at 2 minutes. The result of the operation is shown in Table 1.

TABLE 1

| | Degree of vacuum at the start of blowing oxygen gas (Torr) | Cavity depth (mm) | Carbon concentration before blowing oxygen (ppm) | Carbon concentration after blowing oxygen (ppm) | η (%) | Adhering metal | Evaluation |
|---|---|---|---|---|---|---|---|
| Inventive Example | 165 | 205 | 485 | 127 | 83.6 | Zero | ◎ |
| | 140 | 220 | 479 | 110 | 86.0 | Zero | ◎ |
| | 180 | 120 | 456 | 108 | 81.2 | Zero | ◎ |
| | 120 | 360 | 458 | 97 | 84.3 | Zero | ◎ |
| | 135 | 280 | 444 | 92 | 82.2 | Zero | ◎ |
| | 105 | 215 | 491 | 120 | 86.5 | Approximate zero | ○ |
| | 195 | 150 | 465 | 137 | 76.5 | Zero | ○ |
| | 160 | 400 | 483 | 110 | 87.1 | Approximate zero | ○ |
| Comparative Example | 260* | 195 | 445 | 262 | 42.7 | Zero | x |
| | 75* | 245 | 458 | 92 | 47.1 | A large amount of adhesion | x |
| | 125 | 35* | 482 | 321 | 37.6 | Zero | x |
| | 145 | 460* | 476 | 107 | 86.1 | A large amount of adhesion | x |

Remark: Mark * represents a value outside the range of the present invention.

As can be seen in Table 1, in the example of the present invention, the decarburizing oxygen efficiency η was approximately not less than 80%. That is, it was possible to obtain a high decarburizing oxygen efficiency η, and further there was no adhering metal. On the other hand, in the comparative example, even if the cavity depth was appropriate, when the degree of vacuum at the start of blowing oxygen was too low, although there was no adhesion of base metal, the decarburizing oxygen efficiency η was only a half of that of the present invention. When the degree of vacuum was too high, the decarburizing oxygen efficiency η was deteriorated. That is, the decarburizing oxygen efficiency η was not more than 50%, and there was a large amount of adhering metal.

Even if the vacuum at the start of blowing oxygen was appropriate, when the cavity depth was too small, although there was no adhering metal, the decarburizing oxygen efficiency η was very low. When the cavity depth was too large, although the decarburizing oxygen efficiency η was not less than 80%, there was a large amount adhering metal.

Example 2

In Example 2, while the straight barrel type vacuum refining apparatus shown in FIG. 1 was used, decarburizing operation was carried in which Al heating operation and high vacuum degassing operation were conducted. In this case, the specification of the refining apparatus was the same as that of Example 1.

Concerning the operating condition, the distance G from the lance to the molten steel surface was set at 3.5 m, and the dipping depth H of the vacuum vessel was set at 450 mm. In the above operating condition, oxygen gas was blown to molten steel at a flow rate of 3300 $Nm^3/h$ after one minute had passed from the start of processing. Blowing of oxygen gas was continued for 6 minutes. Depth L of the cavity formed at this time was 205 mm. During the oxygen blowing operation conducted over a period of 6 minutes, Al was charged every one minute, that is, Al was equally charged 5 times. In this case, the amount of Al charged in this way was 460 kg in total. As a result, the molten steel temperature was raised by 40° C. After that, the degassing processing was carried out in an atmosphere, the degree of vacuum of which was 1.5 Torr. An amount of bottom-blown Ar was maintained constant at 1000 Nl/min, and the degree of vacuum was 280 Torr at the start of blowing oxygen and 150 Torr at the end of blowing oxygen.

As a result of the above operation, the heat transfer efficiency ζ of Al heating was 98.9%, and there was no adhering metal. After the above processing, the high vacuum degassing processing was carried out. Before the high vacuum degassing processing, the carbon concentration was 450 ppm, and after the high vacuum degassing processing, the carbon concentration was decreased to 15 ppm.

After the completion of the above operation, the vacuum vessel was raised, so that the dipping depth H was set at 230 mm. Then, the molten steel was stirred for 2 seconds and the decarburizing processing was further conducted in a high vacuum condition. Due to the above processing, as compared with a case in which processing was conducted under the condition that the dipping depth H of the vacuum vessel was set at 450 mm, the processing time necessary for lowering the carbon concentration to 20 ppm was shortened by 4 minutes.

Next, refining was carried out under the operating condition shown in Table 2. In this case, the common condition is described below. The amount of charged Al is 460 kg, a flow rate of oxygen gas is 3000 $Nm^3/h$, and a period of time in which oxygen gas is blown is 6 minutes.

The result is shown in Table 2.

TABLE 2

| | Degree of vacuum at the start of blowing oxygen gas (Torr) | Cavity depth (mm) | Molten steel temperature before blowing oxygen (° C.) | Molten steel temperature after blowing oxygen (° C.) | Temperature rise (° C.) | ζ (%) | Adhering metal | Evaluation |
|---|---|---|---|---|---|---|---|---|
| Inventive Example | 165 | 230 | 1605 | 1647 | 42 | 99.4 | Zero | ◎ |
| | 240 | 205 | 1612 | 1654 | 42 | 98.7 | Zero | ◎ |
| | 290 | 315 | 1597 | 1639 | 42 | 94.6 | Zero | ○ |
| | 105 | 190 | 1614 | 1657 | 43 | 99.5 | Approximate zero | ○ |
| | 240 | 50 | 1589 | 1629 | 39 | 93.4 | Zero | ○ |
| | 200 | 400 | 1607 | 1649 | 42 | 99.2 | Approximate zero | ○ |
| Comparative Example | 60* | 245 | 1611 | 1653 | 42 | 65.9 | A large amount of adhesion | x |
| | 380 | 30* | 1604 | 1632 | 28 | 64.7 | Zero | x |
| | 260 | 550* | 1592 | 1634 | 42 | 99.1 | A large amount of adhesion | x |

Remark: Mark * represents a value outside the range of the present invention.

As can be seen on the second table, in the example of the present invention, the heat transfer efficiency ζ of Al heating was not less than 90%, and there was no adhering metal. However, in the comparative example, the degree of vacuum at the start of blowing oxygen gas was too high, the heat transfer efficiency ζ of Al heating was lower than 70%, and further there was a large amount of adhering metal. Even if the degree of vacuum at the start of blowing oxygen was appropriate, when the cavity depth was too small, although there was no adhering metal, the efficiency ζ was low. When the cavity depth was too large, although the efficiency ζ was not less than 90%, there was a large amount of adhering metal

Example 3

While the straight barrel type vacuum refining apparatus shown in FIG. 1 was used, molten steel refined by a converter was subjected to decarburization, and then Al was charged into the molten steel to conduct deoxidation, and the desulfurizing operation was carried out. In this case, the specification of the refining apparatus was the same as that of Example 1 except for the diameter (109 mm) of the outlet of the top-blowing lance.

Concerning the operating condition, the degree of vacuum was set at 200 Torr, and the distance G from the lance to the molten steel surface was set at 2 m, and a desulfurizing agent in which $CaF_2$ was mixed with CaO by 20% was blown to molten steel for 30 seconds at a speed of 0.4 kg/min/t together with carrier gas (Ar), the flow rate of which was 300 $Nm^3$/Hr. Due to the foregoing, the desulfurizing efficiency λ found by the equation (6) was 0.37. At this time, the back pressure was 4 $kgf/cm^2$, and the flow speed U at which gas arrived on the molten steel surface was 193 m/s (the Mach number was 0.62).

Next, the desulfurizing operation was carried out under the operating condition shown in Table 3. The result is shown in Table 3.

TABLE 3

| | Degree of vacuum during treatment Torr | Flow rate of gas $Nm^3$/Hr | Number of Mach Number M | Flow speed at which oxygen gas arrives on the molten steel surface m/s | λ | Evaluation |
|---|---|---|---|---|---|---|
| Inventive Example | 180 | 300 | 0.65 | 195 | 0.34 | ◎ |
| | 130 | 300 | 0.70 | 180 | 0.36 | ◎ |
| | 270 | 300 | 0.59 | 217 | 0.35 | ◎ |
| | 140 | 5 | 0.11 | 29 | 0.32 | ◎ |
| Comparative Example | 95* | 300 | 0.74 | 162 | 0.22 | x |
| | 420* | 300 | 0.55 | 253 | 0.25 | x |
| | 125 | 1 | 0.03 | 7* | 0.19 | x |

Remark: Mark * represents a value outside the range of the present invention.

As can be seen in Table 3, it was possible to obtain a high desulfurizing efficiency λ of not less than 0.30 in any case. However, in the comparative example, unless the degree of vacuum when treatment is carried out is in the range of the present invention, λ is low, and when the flow rate of gas is low and the gas speed at which gas arrives on the molten steel surface is lower than 10 m/s, the efficiency λ is remarkably deteriorated.

Example 4

While the straight barrel type vacuum refining apparatus shown in FIG. 1 was used, the molten steel heating operation was carried out. In this example, the specification of the refining apparatus was the same as that of Example 1. Concerning the operating condition, the degree of vacuum was maintained at 120 Torr, and distance G from the lance to the molten steel surface was set at 4 m. The flow rate of LPG was 120 $Nm^3$/h, and the flow rate of oxygen was 120 $Nm^3$/h. The heating operation was carried out for 10 minutes after a period of time of 6 minutes had passed from the start of the processing. In this example, the flow rate of Ar blown out by means of bottom-blowing was maintained constant at 1000 Nl/min. Due to the foregoing operation, the temperature was raised by 20° C. compared with a case in which the molten steel heating operation was not carried out.

Example 5

Using the straight barrel type vacuum refining apparatus shown in FIG. 1, the following processing was carried out to process ultra low carbon steel. Molten steel in the vacuum vessel of the above refining apparatus was subjected to Al heating. Then, it was subjected to decarburization by blowing oxygen gas. After that, while the vacuum vessel was maintained in a high vacuum condition, refining of the molten steel was carried out. Finally, burner heating was conducted on the molten steel.

The specification of the refining apparatus was the same as that of Example 1 except for the outlet diameter of the top-blowing lance, which was 110 mm in this example.

Concerning the condition of Al heating, the degree of vacuum was maintained at 250 Torr, and the distance G from the lance to the molten steel surface was set at 3500 mm. Oxygen blowing was conducted at a flow rate of 3300 $Nm^3$/Hr for 4 minutes after one minutes had passed from the start of discharging gas to attain the vacuum condition. At this time, the cavity depth L was 205 mm, the distance N from the lower end of the dipping portion to the molten steel surface in the vacuum vessel was 1400 mm, and the distance (dipping depth) from the lower end of the dipping portion to the molten steel surface outside the vacuum vessel was 450 mm. The flow rate of Ar of bottom-blow was 500 Nl/min. During the oxygen blowing operation conducted over a period of 4 minutes, Al was charged every one minute. In this case, an amount of Al charged in this way was 450 kg in total. As a result, the molten steel temperature was raised by 40° C. at the heat transfer efficiency of 98.2%.

After that, the distance H was set at 230 mm, and the flow rate of Ar was increased to 750 Nl/min, and molten steel was stirred for 1.5 min, so that slag of $Al_2O_3$ in the vacuum vessel was made to flow outside the vacuum vessel completely.

Successively, the degree of vacuum was set at 170 Torr, and oxygen gas was blown into the molten steel for the purpose of decarburization for 3 minutes. In this case, the distance G from the lance to the molten steel surface was 3500 mm, and the flow rate of oxygen gas was 3300 $Nm^3$/Hr. In the above operation, the cavity depth L was 205 mm, the distance N was 1500 mm, and the distance H was 450 mm. While the flow rate of Ar of bottom-blowing was set at 700 Nl/min, the carbon concentration was lowered to a value from 430 to 140 ppm. In this case, the decarburization oxygen efficiency was 85%.

After that, the degree of vacuum was raised to 1 Torr, and oxygen gas was blown into the molten steel for producing ultra low carbon steel.

After the carbon concentration had reached 20 ppm by the above processing, the degree of vacuum was returned to 200 Torr, and alloy was added to molten steel for the adjustment of composition while burner heating was being conducted. In this case, burner heating was conducted for 5 minutes under the following condition. The distance G was set at 4500 mm, the flow rate of LPG was 120 $Nm^3$/Hr, and the flow rate of oxygen gas was 120 $Nm^3$/Hr. As a result, the temperature of molten steel was decreased only by 2° C. during the adjustment of composition.

Example 6

Using a straight barrel type vacuum refining apparatus, the specification of which was the same as that of Example 5, ultra low carbon steel was treated in the following manner. Molten steel in the vacuum vessel of the above apparatus was subjected to Al heating, decarburization conducted by blowing oxygen gas, degassing treatment in a high vacuum condition, deoxidation and desulfurization, and burner heating.

Al heating was carried out in a degree of vacuum of 250 Torr for 4 minutes after one minute had passed from the start of discharging gas to attain the vacuum condition, while the distance G from the lance to the molten steel surface was set at 3.5 m and the flow rate of oxygen gas was set at 3300 $Nm^3$/Hr. In this treatment, the cavity depth L was 205 mm, the distance N from the lower end of the dipping portion to the molten steel surface in the vacuum vessel was 1400 mm, and the distance (dipping depth) H from the lower end of the dipping portion to the molten steel surface outside the vacuum vessel was 450 mm. The flow rate of Ar of bottom-blow was 500 Nl/min, and Al was charged every one minute in the gas blowing and heating treatments for 4 minutes. The amount of Al charged in this process was 450 kg in total. As a result, the temperature of molten steel was raised by 40° C. at the heat transfer efficiency of 98.2%.

After that, the distance H was set at 230 mm, and the flow rate of Ar was increased to 750 Nl/min. Then, the molten steel was stirred for 1.5 min, so that slag of $Al_2O_3$ in the vacuum vessel was made to flow completely outside the vessel.

Successively, the degree of vacuum was set at 170 Torr, and oxygen gas was blown into molten steel for the purpose of decarburization for 3 minutes. In this case, the distance G from the lance to the molten steel surface was set at 3500 mm, and the flow rate of oxygen gas was 3300 $Nm^3$/Hr. In the above operation, the cavity depth L was 205 mm, the distance N from the lower end of the dipping portion to the molten steel surface in the vacuum vessel was 1500 mm, and the distance H (dipping depth) from the lower end of the dipping portion to the molten steel outside the vacuum vessel was 450 mm. While the flow rate of bottom-blown Ar was set at 700 Nl/min, the carbon concentration was lowered to a value from 430 to 140 ppm. In this case, the decarburizing oxygen efficiency was 85%.

After that, the degree of vacuum was raised to 1 Torr, and oxygen gas was blown into the molten steel to produce ultra low carbon steel.

After the carbon concentration had reached 20 ppm by the above processing, the molten steel was subjected to deoxidation by adding Al, and the degree of vacuum was returned to 200 Torr and the distance G was set at 2000 mm. In the above condition, a desulfurizing agent in which $CaF_2$ was mixed with CaO by 20% was blown for 30 seconds at a flow rate of 0.4 kg/t/min. Ar carrier gas was fed at 300 $Nm^3$/Hr, however, the molten steel surface arrival speed of carrier gas Ar was Mach 0.62 (192 m/sec). Although the distance N was 1500 mm, the desulfurizing efficiency was 0.35 and rephosphorization did not occur.

After the sulfur concentration had reached 15 ppm by the above treatment, the degree of vacuum was maintained at 200 Torr, and alloy was added to molten steel for the adjustment of composition while burner heating was being conducted. In this case, burner heating was conducted for 5 minutes under the following condition. The distance G was set at 4500 mm, the flow rate of LPG was 120 $Nm^3$/Hr, and the flow rate of oxygen gas was 120 $Nm^3$/Hr. As a result, the temperature of molten steel was decreased only by 2° C. during the adjustment of composition.

Example 7

Using a straight barrel type vacuum refining apparatus, the specification of which was the same as that of Example 5, ultra low sulfur steel having low hydrogen was processed in the following manner. Molten steel in the vacuum vessel of the above apparatus, the carbon content of which was adjusted to 0.35% in the process of refining in a converter, was subjected to Al heating, degassing treatment in a high vacuum condition, deoxidation and desulfurization, and burner heating.

Al heating was carried out in a degree of vacuum of 250 Torr for 4 minutes after one minute had passed from the start of discharging gas to attain the vacuum condition, while the distance G from the lance to the molten steel surface was set at 3500 mm and the flow rate of oxygen gas was set at 3300 $Nm^3$/Hr. In this operation, the cavity depth L was 205 mm, the distance N from the lower end of the dipping portion to the molten steel surface in the vacuum vessel was 1400 mm, and the distance (dipping depth) H from the lower end of the dipping portion to the molten steel surface outside the vacuum vessel was 450 mm. The flow rate of Ar of bottom-blow was 500 Nl/min, and Al was charged every one minute in the heating process for 4 minutes. The amount of Al charged in this process was 450 kg in total. As a result, the temperature of molten steel was raised by 40° C. at the heat transfer efficiency of 98.2%.

After that, the distance H was set at 230 mm, and the flow rate of Ar was increased to 750 Nl/min. Then, the molten steel was stirred for 1.5 min, so that slag of $Al_2O_3$ in the vacuum vessel was made to flow completely outside the vessel.

After that, the degree of vacuum was increased to 1 Torr, and the hydrogen removal treatment was carried out.

After the hydrogen concentration had reached 1.5 ppm by the above treatment, the molten steel was subjected to deoxidation by adding Al, and the degree of vacuum was returned to 200 Torr and the distance G was set at 2000 mm. In the above condition, a desulfurizing agent in which $CaF_2$ was mixed with CaO by 20% was blown for 30 seconds at a flow rate of 0.4 kg/t/min. Ar carrier gas was fed at 300 $Nm^3$/Hr, however, the molten steel surface arrival speed of carrier gas Ar was Mach 0.62 (192 m/sec). Although the distance N was 1500 mm, the desulfurizing efficiency was 0.35 and rephosphorization did not occur.

After the sulfur concentration had reached 15 ppm by the above treatment, the degree of vacuum was maintained at 200 Torr, and alloy was added to molten steel for the adjustment of composition while burner heating was being conducted. In this case, burner heating was conducted for 5 minutes under the following condition. The distance G was set at 4.5 m, the flow rate of LPG was 120 $Nm^3$/Hr, and the flow rate of oxygen gas was 120 $Nm^3$/Hr. As a result, the temperature of molten steel was decreased only by 2° C. during the adjustment of composition.

Example 8

Using a straight barrel type vacuum refining apparatus, the specification of which was the same as that of Example 5, low carbon steel was treated in the following manner. Molten steel in the vacuum vessel of the above apparatus, the carbon content of which was adjusted to 725 ppm in the process of refining in a converter, was subjected to Al heating, decarburization by blowing oxygen gas, and burner heating.

Al heating was carried out in a degree of vacuum of 250 Torr for 4 minutes after one minute had passed from the start of discharging gas to attain the vacuum condition, while the distance G from the lance to the molten steel surface was set at 3.5 m and the flow rate of oxygen gas was set at 3300 $Nm^3$/Hr. In this operation, the cavity depth L was 205 mm, the distance N from the lower end of the dipping portion to the molten steel surface in the vacuum vessel was 1400 mm, and the distance (dipping depth) H from the lower end of the dipping portion to the molten steel surface outside the vacuum vessel was 450 mm. The flow rate of Ar of bottom-blow was 500 Nl/min, and Al was charged every one minute in the gas blowing and heating treatments for 4 minutes. The amount of Al charged in this process was 450 kg in total. As a result, the temperature of molten steel was raised by 40° C. at the heat transfer efficiency of 98.2%.

After that, the distance H was set at 230 mm, and the flow rate of Ar was increased to 750 Nl/min. Then, the molten steel was stirred for 1.5 min, so that slag of $Al_2O_3$ in the vacuum vessel was made to flow outside the vessel completely.

Successively, the degree of vacuum was set at 170 Torr, and oxygen gas was blown into the molten steel for the purpose of decarburization for 4 minutes. In this case, the distance G was set at 3500 mm, and the flow rate of oxygen gas was 3300 $Nm^3$/Hr. In the above treatment, the cavity depth L was 205 mm, the distance N was 1.5 m, and the distance H (dipping depth) was 450 mm. While the flow rate of Ar of bottom-blow was set at 700 Nl/min, the carbon concentration was lowered to a value from 725 to 415 ppm. In this case, the decarburizing oxygen efficiency was 91%.

After the above processing had been completed, the vacuum was maintained at 200 Torr, and alloy was added to molten steel for the adjustment of composition while burner heating was being conducted. In this case, burner heating was conducted for 5 minutes under the following condition. The distance G was set at 4500 mm, the flow rate of LPG was 120 $Nm^3$/Hr, and the flow rate of oxygen gas was 120 $Nm^3$/Hr. As a result, the temperature of molten steel was decreased only by 2° C. during the adjustment of composition.

Example 9

Using a straight barrel type vacuum refining apparatus, the specification of which was the same as that of Example 5, ultra low carbon steel was processed in the following manner. Molten steel in the vacuum vessel of the above apparatus, the carbon content of which was adjusted to 415 ppm in the process of refining in a converter, was subjected to Al heating and burner heating.

Al heating was carried out in a degree of vacuum of 250 Torr for 4 minutes after one minute had passed from the start of discharging gas to attain the vacuum condition, while the distance G from the lance to the molten steel surface was set at 3,500 mm and the flow rate of oxygen gas was set at 3,300 $Nm^3$/Hr. In this treatment, the cavity depth L was 205 mm, the distance N from the lower end of the dipping portion to the molten steel surface in the vacuum vessel was 1,400 mm, and the distance (dipping depth) H from the lower end of the dipping portion to the molten steel surface outside the vacuum vessel was 450 mm. The flow rate of Ar of bottom-blow was 500 Nl/min, and Al was charged into molten steel every one minute in the heating process for 4 minutes. The amount of Al charged in this treatment was 450 kg in total. As a result, the temperature of molten steel was raised by 40° C. at the heat transfer efficiency of 98.2%.

After that, the distance H was set at 230 mm, and the flow rate of Ar was increased to 750 Nl/min. Then, the molten steel was stirred for 1.5 min, so that slag of $Al_2O_3$ in the vacuum vessel was made to flow outside the vessel completely.

After the temperature had been raised by the above treatment, the degree of vacuum was maintained at 200 Torr, and alloy was added to molten steel for the adjustment of composition while burner heating was being conducted. In this case, burner heating was conducted for 5 minutes under the following condition. The distance G was set at 4500 mm, the flow rate of LPG was 120 $Nm^3$/Hr, and the flow rate of oxygen gas was 120 $Nm^3$/Hr. As a result, the temperature of molten steel was decreased only by 2° C. during the adjustment of composition.

POSSIBILITY OF INDUSTRIAL USE

According to the present invention, at the beginning of processing in which the carbon concentration is high, it is possible to feed oxygen while the decarburizing efficiency is high and there is no adhering metal. Accordingly, it becomes possible to conduct refining for decarburization effectively so that the carbon concentration can be lowered to a value in an ultra low carbon region. Also, it becomes possible to conduct Al heating at a high thermal efficiency. Further, when a desulfurizing refining agent is fed from a lance to molten steel together with carrier gas, it is possible to conduct an effective desulfurization refining. Accordingly, it is possible to provide a highly beneficial effect by the molten steel refining method of the present invention.

We claim:

1. A method of refining molten steel tapped from a converter, by a straight barrel type vacuum refining apparatus, comprising the steps of:

charging molten steel tapped from a converter, the carbon content of which is not more than 0.1 weight %, into a ladle of the straight barrel type vacuum refining apparatus;

dipping an open lower end portion of a vacuum vessel of the refining apparatus into molten steel in the ladle to a predetermined depth so as to form a dipping portion of the vacuum vessel;

maintaining a degree of vacuum of 105 to 195 Torr in a space in the vacuum vessel;

blowing gas for stirring molten steel from a bottom of the ladle; and blowing oxygen gas for decarburization to molten steel from a top-blowing lance capable of freely moving upward and downward inserted into the vacuum vessel via an insertion hole formed on a ceiling of the vacuum vessel so that a cavity, the depth of which is 150 to 400 mm, can be formed on a surface of the molten steel in the vacuum vessel.

2. A method of refining molten steel according to claim 1, wherein a distance from the lower end of the dipping portion of the vacuum vessel to the surface of molten steel in the vacuum vessel is maintained in a range from 1.2 to 2 m.

3. A method of refining molten steel according to claim 1, wherein the dipping portion of the vacuum vessel is raised by a distance of 0.2 H to 0.6 H after the treatment of decarburization conducted by blowing oxygen, with respect to the distance H from the lower end of the vacuum vessel in the process of blowing oxygen for decarburization, to the surface of molten steel outside the vacuum vessel.

4. A method of refining molten steel tapped from a converter, by a straight barrel type vacuum refining apparatus, comprising the steps of:

charging molten steel tapped from a converter into a ladle of the straight barrel type vacuum refining apparatus;

dipping an open lower end portion of a vacuum vessel of the refining apparatus into the molten steel in the ladle by a predetermined depth so as to form a dipping portion of the vacuum vessel;

maintaining a vacuum of 100 to 300 Torr in a space in the vacuum vessel;

blowing gas for stirring molten steel from a bottom of the ladle;

charging Al alloy into the vacuum vessel; and blowing oxygen gas from a top-blowing lance capable of freely moving upward and downward inserted into the vacuum vessel via an insertion hole formed on a ceiling of the vacuum vessel so that the Al alloy melted in the molten steel can be burned to heat the molten steel.

5. A method of refining molten steel according to claim 4, wherein a cavity, the depth of which is 50 to 400 mm, is formed on the surface of molten steel in the vacuum vessel.

6. A method of refining molten steel according to claim 4, wherein a distance from the lower end of the dipping portion of the vacuum vessel to the surface of molten steel in the vacuum vessel is maintained in a range from 1.2 to 2 m.

7. A method of refining molten steel according to claim 4, wherein the dipping portion of the vacuum vessel is raised by a distance of 0.2 H to 0.6 H after a burning period of Al alloy, with respect to the distance H from the lower end of the vacuum vessel in the burning period of Al alloy, to the surface of molten steel outside the vacuum vessel.

8. A method of refining molten steel tapped from a converter, by a straight barrel type vacuum refining apparatus, comprising the steps of:

charging molten steel tapped from a converter into a ladle of the straight barrel type vacuum refining apparatus;

dipping an open lower end portion of a vacuum vessel of the refining apparatus into the molten steel in the ladle to a predetermined depth so as to form a dipping portion of the vacuum vessel;

maintaining a vacuum of 120 to 400 Torr in a space in the vacuum vessel; and blowing a desulfurizing agent to the molten steel in the vacuum vessel together with carrier gas from a top-blowing lance capable of freely moving upward and downward inserted into the vacuum vessel via an insertion hole formed on a ceiling of the vacuum vessel, and also blowing gas for agitation into the molten steel from a lower portion of the ladle so that the molten steel can be desulfurized.

9. A method of refining molten steel according to claim 8, wherein a molten steel surface arrival speed of carrier gas to blow the desulfurizing agent is in a range from 10 m/sec to Mach 1.

10. A method of refining molten steel according to claim 8, wherein a distance from the lower end of the dipping portion of the vacuum vessel to the surface of molten steel in the vacuum vessel is maintained in a range from 1.2 to 2 m.

11. A method of refining molten steel tapped from a converter, by a straight barrel type vacuum refining apparatus, comprising the steps of:

charging molten steel tapped from a converter into a ladle of the straight barrel type vacuum refining apparatus;

dipping an open lower end portion of a vacuum vessel of the refining apparatus into the molten steel in the ladle by a predetermined depth so as to form a dipping portion of the vacuum vessel;

maintaining a vacuum of 100 to 400 Torr in a space in the vacuum vessel; and blowing oxygen gas and combustion improving gas of hydrocarbon onto the surface of molten steel in the vacuum vessel from a top-blowing lance capable of freely moving upward and downward inserted into the vacuum vessel via an insertion hole formed on a ceiling of the vacuum vessel.

12. A method of refining molten steel according to claim 11, wherein a distance from the end of the top-blowing lance to the surface of molten steel in the vacuum vessel is 3.5 to 9.5 m.

13. A method of refining molten steel tapped from a converter, by a straight barrel type vacuum refining apparatus, comprising the steps of:

charging molten steel tapped from a converter, the carbon content of which is not more than 0.1 weight %, into a ladle of the straight barrel type vacuum refining apparatus;

dipping an open lower end portion of a vacuum vessel of the refining apparatus into the molten steel in the ladle to a predetermined depth so as to form a dipping portion of the vacuum vessel;

maintaining a degree of vacuum of 100 to 300 Torr in a space in the vacuum vessel;

blowing gas for agitating molten steel from a bottom of the ladle;

charging Al alloy into the vacuum vessel;

heating the molten steel by burning Al alloy melted in the molten steel when oxygen gas is blown into the vacuum vessel from a top-blowing lance capable of freely moving upward and downward inserted into the vacuum vessel via an insertion hole of the vacuum vessel;

blowing oxygen gas for decarburization of molten steel from the top-blowing lance into the vacuum vessel, the degree of vacuum of which is maintained at 105 to 195 Torr, while a cavity, the depth of which is 150 to 400 mm, is formed by blowing oxygen gas on the surface of heated molten steel in the degree of vacuum vessel; and maintaining a space in the vacuum vessel in a high vacuum condition, the degree of vacuum of which is not more than 100 Torr, so as to conduct degassing treatment on the molten steel that has been subjected to decarburization treatment.

14. A method of refining molten steel according to claim 13, wherein a cavity, the depth of which is 50 to 400 mm, is formed on the surface of molten steel in the vacuum vessel when oxygen gas is blown from the top-blowing lance into the vacuum vessel so as to heat the molten steel by burning Al alloy melted in the molten steel.

15. A method of refining molten steel according to claim 13, wherein the dipping portion of the vacuum vessel is raised by a distance of 0.2 H to 0.6 H before blowing oxygen gas into molten steel for conducting decarburization treatment, with respect to a distance H from the lower end of the dipping portion of the vacuum vessel in a period of burning Al alloy to the surface of molten steel outside the vacuum vessel.

16. A method of refining molten steel according to claim 13, wherein a distance from the lower end of the dipping portion of the vacuum vessel to the surface of molten steel in the vacuum vessel is maintained in a range from 1.2 to 2 m when molten steel is heated by burning Al alloy and subjected to decarburization by blowing oxygen gas.

17. A method of refining molten steel tapped from a converter, by a straight barrel type vacuum refining apparatus, comprising the steps of:

charging molten steel tapped from a converter, into a ladle of the straight barrel type vacuum refining apparatus;

dipping an open lower end portion of a vacuum vessel of the refining apparatus into the molten steel in the ladle by a predetermined depth so as to form a dipping portion of the vacuum vessel;

maintaining a degree of vacuum of 100 to 300 Torr in a space in the vacuum vessel;

blowing gas for stirring molten steel from a bottom of the ladle;

raising the temperature of molten steel by burning Al alloy melted in the molten steel when Al alloy is charged into the vacuum vessel and oxygen gas is blown from a top-blowing lance capable of moving upward and downward inserted into the vacuum vessel via an insertion hole formed on a ceiling of the vacuum vessel;

conducting hydrogen removal treatment on the molten steel, the temperature of which is raised while the space in the vacuum vessel is maintained in a high vacuum condition of not more than 100 Torr; and conducting desulfurization processing on the molten steel when the space in the vacuum vessel is maintained in a degree of vacuum of 120 to 400 Torr and a desulfurizing agent is blown from the top-blowing lance to the molten steel in the vacuum vessel together with carrier gas and also when a gas for stirring molten steel is blown into molten steel from a bottom of the ladle.

18. A method of refining molten steel according to claim 17, wherein a distance from the lower end of the dipping portion of the vacuum vessel to the surface of molten steel in the vacuum vessel is maintained in a range from 1.2 to 2 m.

19. A method of refining molten steel according to claim 17, wherein the dipping portion of the vacuum vessel is raised by a distance of 0.2 H to 0.6 H before the degassing treatment conducted in a high vacuum condition, with respect to a distance H from the lower end of the dipping portion of the vacuum vessel in a period of burning Al alloy to the surface of molten steel outside the vacuum vessel.

20. A method of refining molten steel according to claim 17, wherein a cavity, the depth of which is 50 to 400 mm, is formed on the surface of molten steel in the vacuum vessel when oxygen gas is blown from the top-blowing lance into the vacuum vessel so as to heat the molten steel by burning Al alloy melted in the molten steel.

21. A method of refining molten steel tapped from a converter, by a straight barrel type vacuum refining apparatus, comprising the steps of:

charging molten steel tapped from a converter, the carbon content of which is not more than 0.1 weight %, into a ladle of the straight barrel type vacuum refining apparatus;

dipping an open lower end portion of a vacuum vessel of the refining apparatus into the molten steel in the ladle by a predetermined depth so as to form a dipping portion of the vacuum vessel;

maintaining a degree of vacuum of 100 to 300 Torr in a space in the vacuum vessel;

blowing gas for stirring molten steel from a bottom of the ladle;

charging Al alloy into the vacuum vessel;

blowing oxygen gas from a top-blowing lance capable of freely moving upward and downward inserted into the vacuum vessel via an insertion hole formed on a ceiling of the vacuum vessel so that Al alloy melted in the molten steel can be burned to heat the molten steel;

blowing oxygen gas for decarburization from the top-blowing lance onto molten steel in the vacuum vessel when the space in the vacuum vessel is maintained in a vacuum condition of 105 to 195 Torr and a cavity, the depth of which is 150 to 400 mm, is formed by blowing oxygen gas on the surface of the heated molten steel in the vacuum vessel;

conducting degassing treatment on the molten steel, which has been subjected to decarburization treatment, while the space in the vacuum vessel is maintained in a high vacuum condition of not more than 100 Torr;

conducting desulfurization processing on the molten steel when the space in the vacuum vessel is maintained in a degree of vacuum of 120 to 400 Torr and a desulfurizing agent is blown from the top-blowing lance to the molten steel in the vacuum vessel together with carrier gas; and blowing both oxygen gas and combustion improving gas of hydrocarbon from the top-blowing lance to the surface of the desulfurized molten steel in the vacuum vessel so as to heat it while the space in the vacuum vessel is maintained in a degree of vacuum of 100 to 400 Torr.

22. A method of refining molten steel according to claim 21, wherein the distance from the lower end of the dipping portion of the vacuum vessel to the surface of molten steel in the vacuum vessel is maintained in a range from 1.2 to 2 m in the heating treatment of molten steel conducted by burning Al alloy, the decarburizing treatment conducted by blowing oxygen gas, or the desulfurizing treatment.

23. A method of refining molten steel according to claim 21, wherein a distance from the end of the top-blowing lance to the surface of molten steel in the vacuum vessel is maintained in a range from 3.5 to 9.5 m when molten steel is heated by burning oxygen gas and a combustion improving gas of hydrocarbon.

24. A method of refining molten steel according to claim 21, wherein the dipping portion of the vacuum vessel is raised by a distance from 0.2 H to 0.6 H before the molten steel is subjected to decarburization by blowing oxygen gas, with respect to a distance H from the lower end of the dipping portion of the vacuum vessel in a period of burning Al alloy to the surface of molten steel outside the vacuum vessel.

25. A method of refining molten steel according to claim 21, wherein a cavity, the depth of which is 50 to 400 mm, is formed on the surface of molten steel in the vacuum vessel when oxygen gas is blown into the vacuum vessel from the top-blowing lance so as to burn Al alloy melted in the molten steel to heat the molten steel.

* * * * *

UNITED STATES PATENT AND TRADEMARK OFFICE

CERTIFICATE OF CORRECTION

PATENT NO. : 5,902,374

DATED : May 11, 1999

INVENTOR(S) : Shinya KITMURA, et al.

It is certified that error appears in the above-identified patent and that said Letters Patent is hereby corrected as shown below:

Column 31, line 36, delete "degree of".

Signed and Sealed this

Eighth Day of May, 2001

*Attest:*

Nicholas P. Godici

NICHOLAS P. GODICI

*Attesting Officer*

*Acting Director of the United States Patent and Trademark Office*